US010029472B2

(12) United States Patent
Okazaki et al.

(10) Patent No.: US 10,029,472 B2
(45) Date of Patent: Jul. 24, 2018

(54) LIQUID CARTRIDGE PROVIDED WITH DEFORMABLE MEMBER AND MOVABLE MEMBER FOR DETECTION OF REMAINING AMOUNT OF LIQUID

(71) Applicant: BROTHER KOGYO KABUSHIKI KAISHA, Nagoya-shi, Aichi-ken (JP)

(72) Inventors: Naoya Okazaki, Gifu-ken (JP); Tetsuro Kobayashi, Nagoya (JP); Suguru Tomoguchi, Okazaki (JP); Akihito Ono, Nagoya (JP); Kosuke Nukui, Nagoya (JP); Hiroaki Takahashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/276,958

(22) Filed: Sep. 27, 2016

(65) Prior Publication Data

US 2017/0282583 A1 Oct. 5, 2017

(30) Foreign Application Priority Data

Mar. 31, 2016 (JP) ..... 2016-072382

(51) Int. Cl.
*B41J 2/175* (2006.01)
*B41J 29/13* (2006.01)

(52) U.S. Cl.
CPC ..... *B41J 2/17566* (2013.01); *B41J 2/1752* (2013.01); *B41J 2/17503* (2013.01); (Continued)

(58) Field of Classification Search
CPC ..... B41J 2/17503; B41J 2/17513; B41J 2/17556; B41J 2/17566; B41J 2/17573
See application file for complete search history.

(56) References Cited

U.S. PATENT DOCUMENTS 5,136,309 A 8/1992 Iida et al.
5,736,992 A 4/1998 Pawlowski, Jr.
(Continued)

FOREIGN PATENT DOCUMENTS

CN 201645998 U 11/2010
EP 2 371 555 A2 10/2011
(Continued)

OTHER PUBLICATIONS

Ma, MachineTranslationofWO 2011050759 A1, 2011.*
(Continued)

*Primary Examiner* — Geoffrey Mruk
*Assistant Examiner* — Scott A Richmond
(74) *Attorney, Agent, or Firm* — Merchant & Gould P.C.

(57) ABSTRACT

A liquid cartridge includes: a casing including a liquid chamber; a liquid supply portion; a deformable member; a movable member; and a support member. The liquid chamber is configured such that an internal pressure of the liquid chamber is reduced as liquid flows out of the liquid chamber. The liquid supply portion allows liquid in the liquid chamber to flow out of the liquid chamber. The deformable member protrudes further upward relative to an upper surface of the casing. The deformable member has an internal space in communication with the liquid chamber. The deformable member is elastically deformable such that a volume of the internal space is reduced as the internal pressure of the liquid chamber is reduced. The movable member includes a detection portion movable in upward and downward directions in accordance with the elastic deformation of the deformable member. The support member supports the movable member.

17 Claims, 14 Drawing Sheets

(52) U.S. Cl.
CPC ..... *B41J 2/17509* (2013.01); *B41J 2/17513* (2013.01); *B41J 2/17523* (2013.01); *B41J 2/17546* (2013.01); *B41J 2/17553* (2013.01); *B41J 29/13* (2013.01)

(56) References Cited

U.S. PATENT DOCUMENTS

| | | | | |
|---|---|---|---|---|
| 7,424,824 | B2 * | 9/2008 | Usui | B41J 2/17513 73/290 V |
| 8,317,306 | B2 | 11/2012 | Hattori | |
| 2009/0289972 | A1 | 11/2009 | Iino | |
| 2011/0249064 | A1 | 10/2011 | Wang et al. | |
| 2011/0292138 | A1 * | 12/2011 | Ma | B41J 2/17566 347/86 |
| 2011/0310194 | A1 | 12/2011 | Takagi | |
| 2013/0033552 | A1 | 2/2013 | Chen et al. | |
| 2013/0141499 | A1 | 6/2013 | Tomoguchi et al. | |
| 2014/0098145 | A1 | 4/2014 | Kanbe | |
| 2014/0300671 | A1 | 10/2014 | Nie | |
| 2016/0039215 | A1 | 2/2016 | Sugahara et al. | |
| 2017/0282585 | A1 | 10/2017 | Kobayash | |

FOREIGN PATENT DOCUMENTS

| | | | | |
|---|---|---|---|---|
| EP | 2 524 810 | A1 | 11/2012 | |
| EP | 2 607 088 | A2 | 6/2013 | |
| JP | 3156861 | U | 1/2010 | |
| JP | 3157392 | U | 2/2010 | |
| WO | WO 2011050759 | A1 * | 5/2011 | B41J 2/17513 |

OTHER PUBLICATIONS

Application as filed in related U.S. Appl. No. 15/277,030, filed Sep. 27, 2016.
Application as filed in related U.S. Appl. No. 15/277,074, filed Sep. 27, 2016.
Application as filed in related U.S. Appl. No. 15/276,927, filed Sep. 27, 2016.
"Extended European Search Report issued in related EP application No. 16190843.9, dated Jul. 27, 2017."
Extended European Search Report issued in related EP application No. 16190817.3, dated Sep. 13, 2017.
Extended European Search Report issued in related EP application No. 16190815.7, dated Aug. 22, 2017.
Office Action issued in related U.S. Appl. No. 15/277,030, dated Nov. 3, 2017.
Office Action (Notice of Allowance) issued in related U.S. Appl. No. 15/276,927, dated Nov. 3, 2017.
Extended European Search Report issued in related European Application No. 16190768.8, dated Nov. 27, 2017.
Office Action issued in related U.S. Appl. No. 15/277,074, dated Oct. 6, 2017.
U.S. Office Action (Notice of Allowance) issued in related U.S. Appl. No. 15/277,030, dated Mar. 28, 2018.
U.S. Office Action (Notice of Allowance) issued in related U.S. Appl. No. 15/277,074, dated Jun. 4, 2018.

* cited by examiner

LIQUID CARTRIDGE PROVIDED WITH DEFORMABLE MEMBER AND MOVABLE MEMBER FOR DETECTION OF REMAINING AMOUNT OF LIQUID

CROSS REFERENCE TO RELATED APPLICATION

This application claims priority from Japanese Patent Application No. 2016-072382 filed Mar. 31, 2016. The entire content of the priority application is incorporated herein by reference.

TECHNICAL FIELD

The present disclosure relates to a liquid cartridge provided with a movable member that moves in accordance with elastic deformation of a deformable member.

BACKGROUND

There are conventional inkjet recording apparatus known in the art that can record an image on a recording medium by ejecting ink stored in an ink container through nozzles. One such inkjet recording apparatus is configured such that a new ink cartridge can be attached every time ink in an ink cartridge that has been attached is consumed.

Japanese Utility Model Registration Publication No. 3156861 discloses an ink cartridge that can be attached to and detached from a cartridge attachment section of an inkjet recording apparatus. The ink cartridge has a detection mechanism that is used for optical detection of a remaining amount of ink. The detection mechanism includes a movable bar that can pivotally move about a fixed shaft, and a soft support cap. When ink stored in an ink bag is consumed, the ink bag deflates. As the ink bag deflates, the soft support cap also deflates. This causes the movable bar to change its pivoting posture. By optically detecting the change in the pivoting posture of the movable bar, consumption of ink in the ink cartridge can be detected.

SUMMARY

In the above-described ink cartridge, since an internal space of the soft support cap is in communication with the ink bag, ink may flow into the internal space of the soft support cap. Hence, deformation of the soft support cap may become unstable depending on whether or not ink is present in the internal space of the soft support cap. Accordingly, an amount of ink remaining in the ink bag when the movable bar pivotally moves also becomes unstable, thereby making accurate detection of the remaining amount of ink difficult.

In view of the foregoing, it is an object of the disclosure to provide a liquid cartridge that enables accurate detection of a remaining amount of liquid.

In order to attain the above and other objects, the disclosure provides a liquid cartridge including: a casing; a liquid supply portion; a deformable member; a movable member; and a support member. The casing includes a liquid chamber configured to store liquid therein. The liquid chamber is configured such that an internal pressure of the liquid chamber is reduced in accordance with outflow of liquid from the liquid chamber. The casing includes a front surface and an upper surface defined based on an attached posture of the liquid cartridge. The liquid supply portion is disposed at the front surface and configured to allow liquid in the liquid chamber to flow out of the liquid chamber. The deformable member protrudes further upward relative to the upper surface of the casing. The deformable member has an internal space in communication with the liquid chamber. The deformable member is configured to be elastically deformable such that a volume of the internal space is reduced in accordance with the reduction in the internal pressure of the liquid chamber. The movable member includes a detection portion configured to move in an upward direction and a downward direction in accordance with the elastic deformation of the deformable member. The support member supports the movable member.

Note that the attached posture of the liquid cartridge implies a posture of the liquid cartridge in a state where the liquid cartridge has been completely attached to a cartridge attachment section of an inkjet recording apparatus, for example. The attached posture also implies a posture of the liquid cartridge attachable to the cartridge attachment section but not yet attached to the cartridge attachment section.

BRIEF DESCRIPTION OF THE DRAWINGS

The particular features and advantages of the embodiment(s) as well as other objects will become apparent from the following description taken in connection with the accompanying drawings, in which:

FIGS. 13A through 13D are schematic vertical cross-sectional views of an ink cartridge 230 according to a first modification to the embodiment, in which FIG. 13A illustrates a state where an opening 258 is opened; and FIG. 13B illustrates a state where the opening 258 is closed; FIG. 13C illustrates a state where an ink channel 244 is under a negative pressure; and FIG. 13D illustrates a state where an opening 255 is opened.

DETAILED DESCRIPTION

Figure 1:
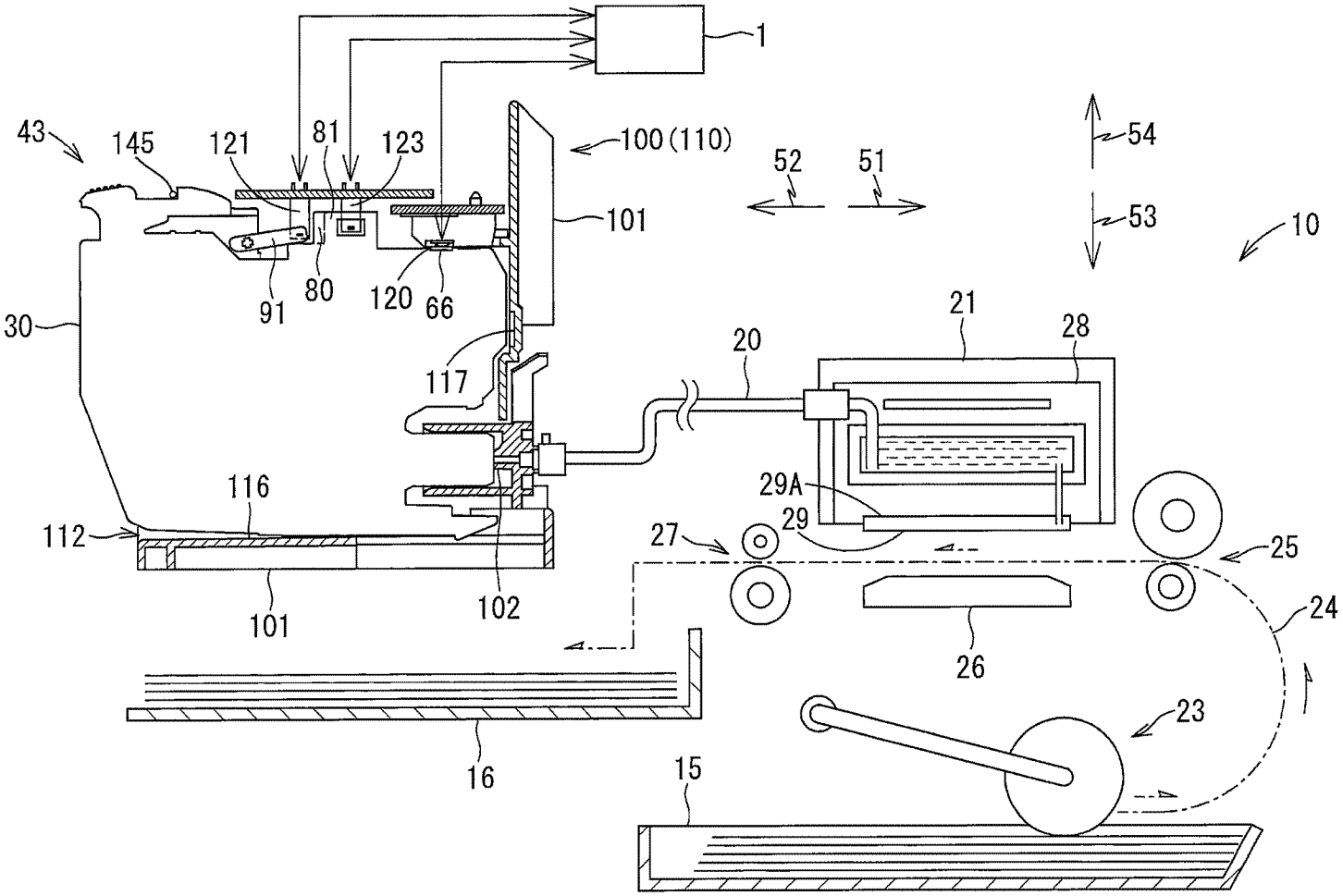
FIG. 1 is a schematic cross-sectional diagram illustrating an internal structure of a printer 10 provided with a cartridge attachment section 110 to which an ink cartridge 30 according to one embodiment is detachably attached.

An ink cartridge 30 as an example of a liquid cartridge according to one embodiment and a printer 10 configured to accommodate the ink cartridge 30 will be described with reference to FIGS. 1 through 12, wherein like parts and components are designated by the same reference numerals to avoid duplicating description.

In the following description, a direction in which the ink cartridge 30 is inserted into a cartridge attachment section 110 is defined as a forward direction 51, and a direction opposite to the forward direction 51, that is, a direction in which the ink cartridge 30 is removed from the cartridge attachment section 110 is defined as a rearward direction 52. The forward direction 51 and the rearward direction 52 are parallel to a horizontal direction in the embodiment, but the forward direction 51 and the rearward direction 52 may not necessarily be parallel to the horizontal direction.

Further, a direction orthogonal to the forward direction 51 and the rearward direction 52 is defined as an upward direction 54, and a direction opposite the upward direction 54 is defined as a downward direction 53. In the embodiment, the upward direction 54 is a vertically upward direction, while the downward direction 53 is a vertically downward direction. In other words, the downward direction 53 is a direction of a gravitational force acting on the ink cartridge 30. Note that the upward direction 54 and the downward direction 53 may not necessarily be parallel to a vertical direction.

Further, directions orthogonal to the forward direction 51 and the downward direction 53 are defined as a rightward direction 55 and a leftward direction 56. More specifically, when the ink cartridge 30 has been inserted into the cartridge attachment section 110, i.e., when the ink cartridge 30 is in a posture attachable to the cartridge attachment section 110 (i.e. an operational posture), a direction toward the right is defined as the rightward direction 55 and a direction toward the left is defined as the leftward direction 56 when the ink cartridge 30 is viewed in the forward direction 51, i.e., when the ink cartridge 30 is viewed from the rear to the front. In the embodiment, the rightward direction 55 and the leftward direction 56 are parallel to the horizontal direction, but the rightward direction 55 and the leftward direction 56 may not necessarily be parallel to the horizontal direction.

<Overview of Printer 10>

The printer 10 is configured to selectively eject ink droplets onto recording sheets to record images thereon based on an inkjet recording method. As illustrated in FIG. 1, the printer 10 includes a recording head 21, an ink supply device 100, and ink tubes 20 connecting the recording head 21 to the ink supply device 100. The ink supply device 100 includes the cartridge attachment section 110. A plurality of ink cartridges 30 is attachable to and detachable from the cartridge attachment section 110. The cartridge attachment section 110 has one end in which an opening 112 is formed. The ink cartridges 30 can be inserted into the cartridge attachment section 110 through the opening 112 in the forward direction 51, and can be removed from the cartridge attachment section 110 through the opening 112 in the rearward direction 52.

In the embodiment, four ink cartridges 30 corresponding to respective four colors of cyan, magenta, yellow, and black can be accommodated in the cartridge attachment section 110 of the ink supply device 100. For an explanatory purpose, in the following description and in the drawings, only one ink cartridge 30 is assumed to be attached to the cartridge attachment section 110 unless otherwise specified.

In FIG. 1, details of an internal structure of the ink cartridge 30 is omitted. The ink cartridge 30 stores ink (an example of liquid) that can be used in the printer 10. When the ink cartridge 30 has been completely attached to the cartridge attachment section 110, the ink cartridge 30 and the recording head 21 are connected by corresponding one of the ink tubes 20. The recording head 21 is provided with a plurality of (four in the embodiment) sub-tanks 28 corresponding to the plurality of ink cartridges 30. Each sub-tank 28 is configured to temporarily store the ink supplied from the corresponding ink cartridge 30 through the corresponding ink tube 20. The recording head 21 is configured to selectively eject the ink supplied from the respective sub-tanks 28 through nozzles 29 according to an inkjet recording method. More specifically, the recording head 21 is provided with a head control board, and piezoelectric elements 29A corresponding one-on-one to the nozzles 29. The head control board selectively applies drive voltages to the piezoelectric elements 29A to eject ink selectively from the nozzles 29.

The printer 10 includes a sheet feeding tray 15, a sheet feeding roller 23, a pair of conveying rollers 25, a platen 26, a pair of discharge rollers 27, and a sheet discharge tray 16. The sheet feeding roller 23 feeds recording sheets from the sheet feeding tray 15 onto a conveying path 24, and the conveying rollers 25 convey the recording sheets over the platen 26. The recording head 21 selectively ejects ink onto the recording sheets as the recording sheets pass over the platen 26, whereby images are recorded on the recording sheets and ink stored in the ink cartridge 30 completely attached to the cartridge attachment section 110 is consumed. The discharge rollers 27 receive the recording sheets that have passed over the platen 26 and discharge the recoding sheets onto the sheet discharge tray 16 provided at a position most downstream in the conveying path 24.

<Ink Supply Device 100>

As illustrated in FIG. 1, the ink supply device 100 is provided in the printer 10. The ink supply device 100 is configured to supply ink to the recording head 21 provided in the printer 10. The ink supply device 100 includes the cartridge attachment section 110 to which the ink cartridges 30 can be detachably attached. Incidentally, FIG. 1 illustrates a state of the ink cartridge 30 that has been completely attached to the cartridge attachment section 110.

<Cartridge Attachment Section 110>

Figure 2:
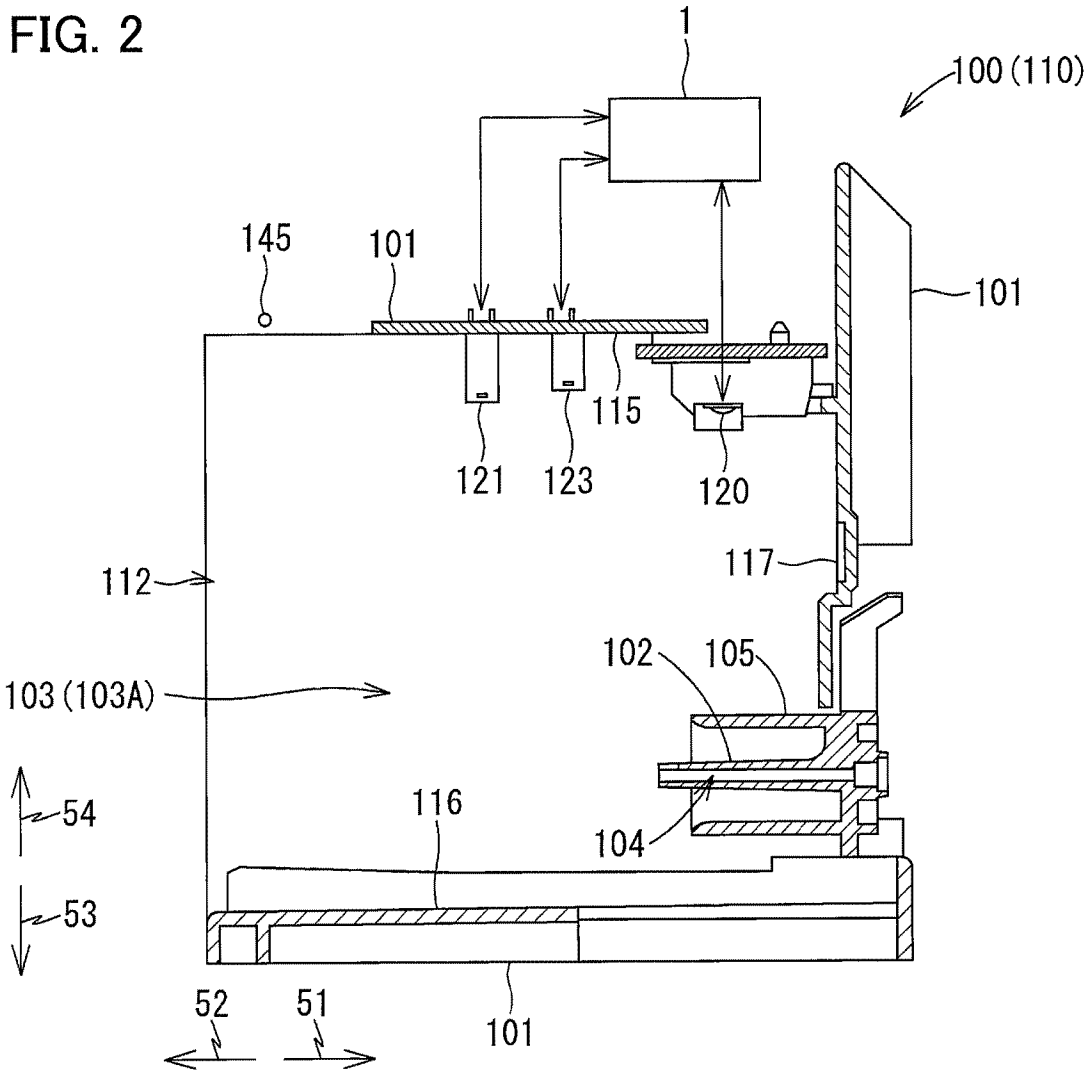
FIG. 2 is a schematic vertical cross-sectional view of the cartridge attachment section 110.

As illustrated in FIG. 2, the cartridge attachment section 110 includes a case 101, a plurality of ink needles 102, a plurality of optical sensors 121, a plurality of optical sensors 123, a plurality of locking rods 145, and a plurality of sets of a plurality of contacts 120.

The case 101 is partitioned into four spaces arranged in the rightward direction 55 and the leftward direction 56. In the four spaces, the four ink cartridges 30 corresponding to the four ink colors cyan, magenta, yellow, and black can be accommodated, respectively.

In the embodiment, four ink needles 102, four optical sensors 121, four optical sensors 123, four locking rods 145, and four sets of a plurality of contacts 120 are provided in the cartridge attachment section 110 so as to correspond with the four ink cartridges 30.

The four ink needles 102 are arranged in the rightward direction 55 and the leftward direction 56, and have the same configuration. The four optical sensors 121 are arranged in the rightward direction 55 and the leftward direction 56, and have the same configuration. The four optical sensors 123 are arranged in the rightward direction 55 and the leftward direction 56, and have the same configuration. The four locking rods 145 are arranged in the rightward direction 55 and the leftward direction 56, and have the same configuration. The four sets of a plurality of contacts 200 are arranged in the rightward direction 55 and the leftward direction 56, and have the same configuration.

Hence, in the following description, for the sake of simplicity of explanation, configurations of respective one of the four ink needles 102, the four optical sensors 121, the four optical sensors 123, the four locking rods 145, and the four sets of a plurality of contacts 200 will be described in detail, while configurations of respective remaining three of the four ink needles 102, the four optical sensors 121, the four optical sensors 123, the four locking rods 145, and the four sets of a plurality of contacts 200 will be omitted.

<Case 101>

As illustrated in FIG. 2, the case 101 constitutes a housing of the cartridge attachment section 110, and is formed in a box shape. The case 101 has an inner top surface 115, an inner bottom surface 116, an inner end surface 117, and the opening 112.

The inner top surface 115 defines a top portion of an internal space 103 of the case 101. The inner bottom surface 116 defines a bottom portion of the internal space 103 of the case 101. The inner end surface 117 defines an end portion of the internal space 103 of the case 101 in the forward direction 51. The inner end surface 117 connects the inner top surface 115 to the inner bottom surface 116. The opening 112 is positioned rearward of the inner end surface 117 and arranged to face the inner end surface 117 in the rearward direction 52. The opening 112 can be exposed to a user interface surface of the printer 10, that is, a surface that a user can face when the using the printer 10.

Each of the four ink cartridges 30 is inserted into and removed from the case 101 through the opening 112. The case 101 is provided with three partitioning plates (not illustrated) that partition the internal space 103 into four spaces 103A each elongated in the downward direction 53 and the upward direction 54. The four ink cartridges 30 can be detachably accommodated in the four spaces 103A partitioned by the three partitioning plates, respectively.

The opening 112 formed in the case 101 can be opened and closed by a cover (not illustrated). The cover is attached to a pivot shaft (not illustrated) that extends in the rightward direction 55 and the leftward direction 56 near a lower edge of the opening 112. With this configuration, the cover can be pivotally moved about the pivot shaft to a closed position where the opening 112 is closed and an open position where the opening 112 is opened. When the cover is at the open position, the user can insert the ink cartridge 30 into the case 101 and remove the ink cartridge 30 from the case 101 through the opening 112. When the cover is at the closed position, the user cannot insert the ink cartridge 30 into the case 101 or remove the ink cartridge 30 from the case 101, nor can the user access the ink cartridge 30 accommodated in the case 101.

A cover sensor 118 (see FIG. 10) is provided at the case 101 near an upper edge of the opening 112. The cover sensor 118 is a sensor used for detection as to whether the cover is in contact with the cover sensor 118. When the cover is at the closed position, an upper end portion of the cover is in contact with the cover sensor 118, and the cover sensor 118 outputs a detection signal to the controller 1. When the cover is not at the closed position, the cover sensor 118 does not output a detection signal.

<Ink Needle 102>

As illustrated in FIG. 2, the ink needle 102 is made of a resin having a tubular configuration. The ink needle 102 is provided at a lower portion of the inner end surface 117 of the case 101. The ink needle 102 is disposed on the inner end surface 117 of the case 101 at a position corresponding to an ink supply portion 34 (see FIG. 3, described later) of the ink cartridge 30 attached to the cartridge attachment section 110. The ink needle 102 protrudes in the rearward direction 52 from the inner end surface 117 of the case 101.

A cylindrical-shaped guide portion 105 is provided to surround the ink needle 102. The guide portion 105 protrudes in the rearward direction 52 from the inner end surface 117 of the case 101. The guide portion 105 has a protruding end that is opened. The ink needle 102 is disposed at a center of the guide portion 105. The guide portion 105 is formed in a shape allowing the ink supply portion 34 of the ink cartridge 30 to be inserted into the guide portion 105.

In the process of the ink cartridge 30 to be inserted into the cartridge attachment section 110 in the forward direction 51, that is, in the process of the ink cartridge 30 to be moved to an attached position in the cartridge attachment section 110, the ink supply portion 34 of the ink cartridge 30 is inserted into the guide portion 105. When the ink cartridge 30 is further inserted into the cartridge attachment section 110 in the forward direction 51, the ink needle 102 enters into an ink supply port 71 (see FIG. 3) that is formed in the ink supply portion 34. The ink needle 102 and the ink supply portion 34 can thus be connected to each other. Hence, ink stored in an ink chamber 36 (see FIG. 4) formed inside the ink cartridge 30 flows into the corresponding ink tube 20 connected to the ink needle 102 through an internal space 106 (see FIG. 4) of the ink supply portion 34 and an internal space 104 (see FIG. 2) of the ink needle 102. The ink needle 102 may have a flat-shaped tip end or a pointed tip end.

<Optical Sensors 121 and 123>

As illustrated in FIG. 2, the optical sensor 121 and the optical sensor 123 are disposed on the inner top surface 115 of the case 101. The optical sensor 123 is disposed further in the forward direction 51 (i.e. forward) relative to the optical sensor 121.

The optical sensor 121 includes a light emitting part (not illustrated) and a light receiving part (not illustrated). The light emitting part of the optical sensor 121 and the light receiving part of the optical sensor 121 are arranged to face each other in the rightward direction 55 and the leftward direction 56. The light emitting part of the optical sensor 121 is disposed at a right end portion of the space 103A in the internal space 103. The light receiving part of the optical sensor 121 is disposed at a left end portion of the space 103A. The right and left positions of the light emitting part of the optical sensor 121 and the light receiving part of the optical sensor 121 may be arranged in reverse.

The optical sensor 123 includes a light emitting part (not illustrated) and a light receiving part (not illustrated). The light emitting part of the optical sensor 123 and the light receiving part of the optical sensor 123 are arranged to face each other in the rightward direction 55 and the leftward direction 56. The light emitting part of the optical sensor 123 is disposed at the right end portion of the space 103A. The light receiving part of the optical sensor 123 is disposed at the left end portion of the space 103A. The right and left positions of the light emitting part of the optical sensor 123 and the light receiving part of the optical sensor 123 may be arranged in reverse.

The optical sensor 121 and the optical sensor 123 are electrically connected to a controller 1 of the printer 10 through an electrical circuit. The controller 1 will be described later in detail.

<Locking Rod 145>

As illustrated in FIG. 2, the locking rod 145 is disposed near the inner top surface 115 of the case 101 and near the opening 112, and extends in the leftward direction 56 and the rightward direction 55. The locking rod 145 is a rod-like member that extends in the leftward direction 56 and the rightward direction 55. The locking rod 145 is, for example, a metal columnar member. Both ends of the locking rod 145 in the leftward direction 56 and the rightward direction 55 are fixed to walls that define both ends of the case 101 in the leftward direction 56 and the rightward direction 55.

The locking rod 145 is adapted to retain the ink cartridge 30 attached to the cartridge attachment section 110 at its attached position. The ink cartridge 30 inserted into the cartridge attachment section 110 is engaged with the locking rod 145. In this way, the ink cartridge 30 is retained in the cartridge attachment section 110.

<Contact 120>

As illustrated in FIG. 2, the plurality of contacts 120 is disposed near the inner top surface 115 of the case 101 and near the inner end surface 117 of the case 101. The plurality of contacts 120 are provided so as to correspond with a plurality of electrodes (not illustrated) provided at an IC board 66 (described later). When the ink cartridge 30 has been attached to the cartridge attachment section 110, the plurality of contacts 120 are electrically connected to the IC board 66.

<Ink Cartridge 30>

Figure 3:
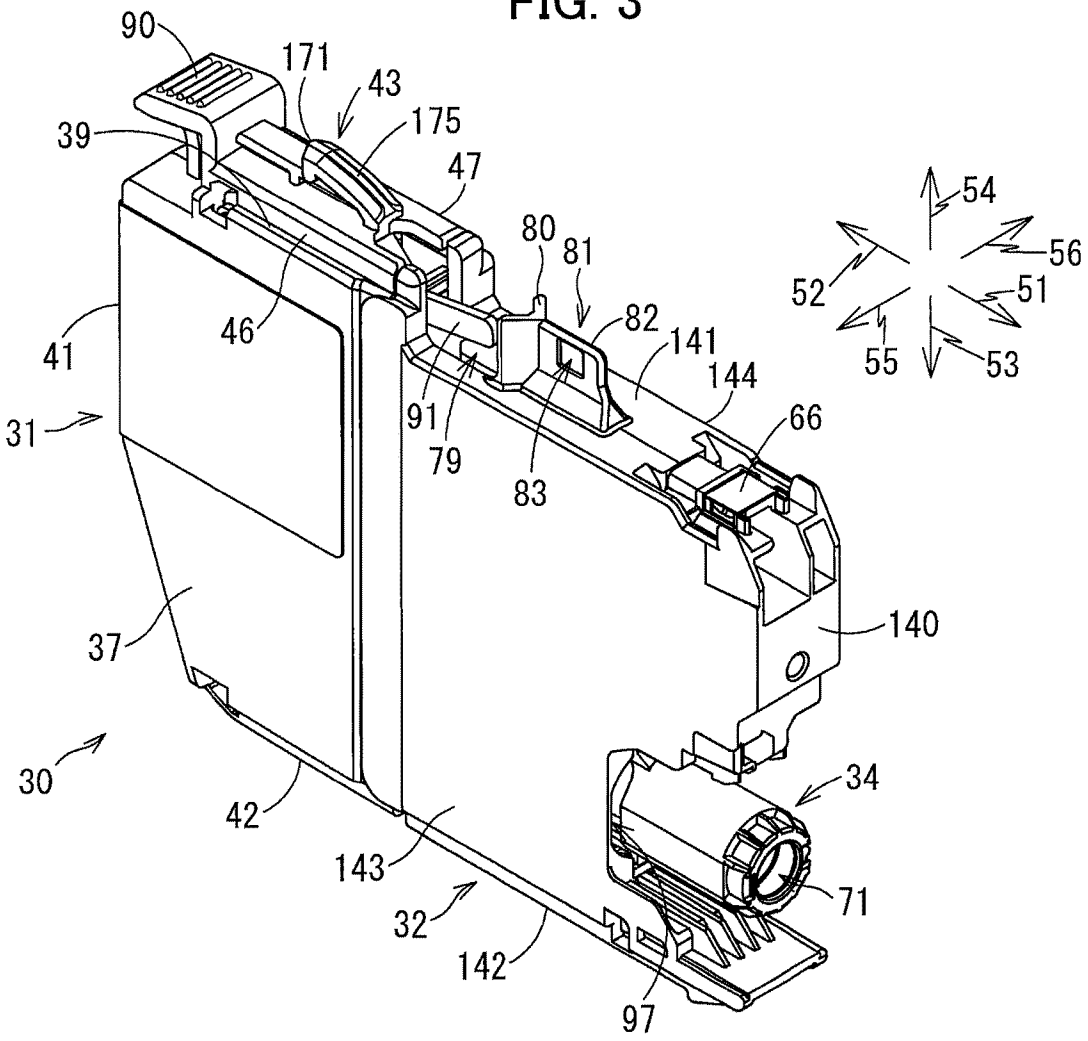
FIG. 3 is a perspective view of the ink cartridge 30.
Figure 4:
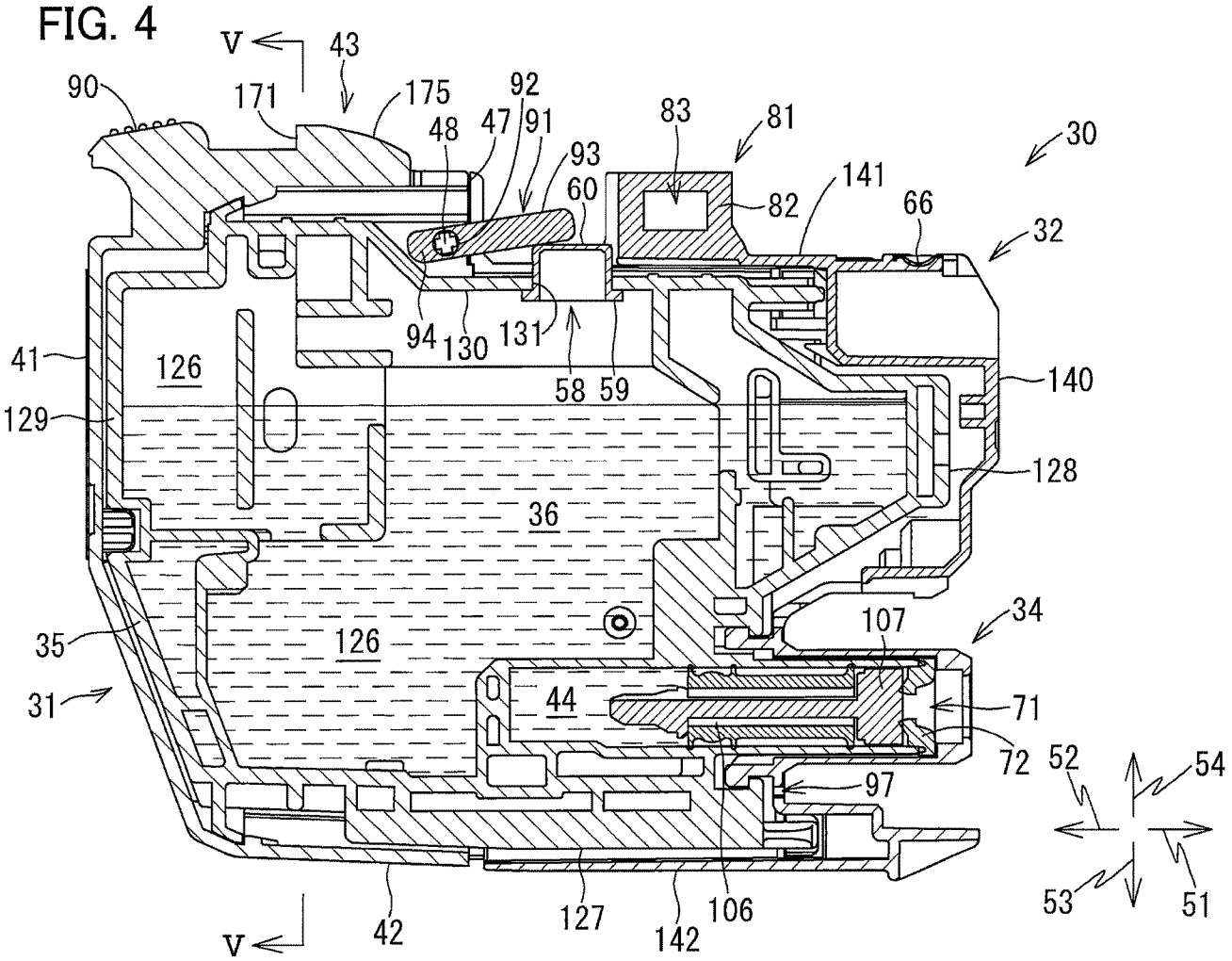
FIG. 4 is a vertical cross-sectional view of the ink cartridge 30 in which a detection portion 93 of a movable member 91 is at a first position.
Figure 5:
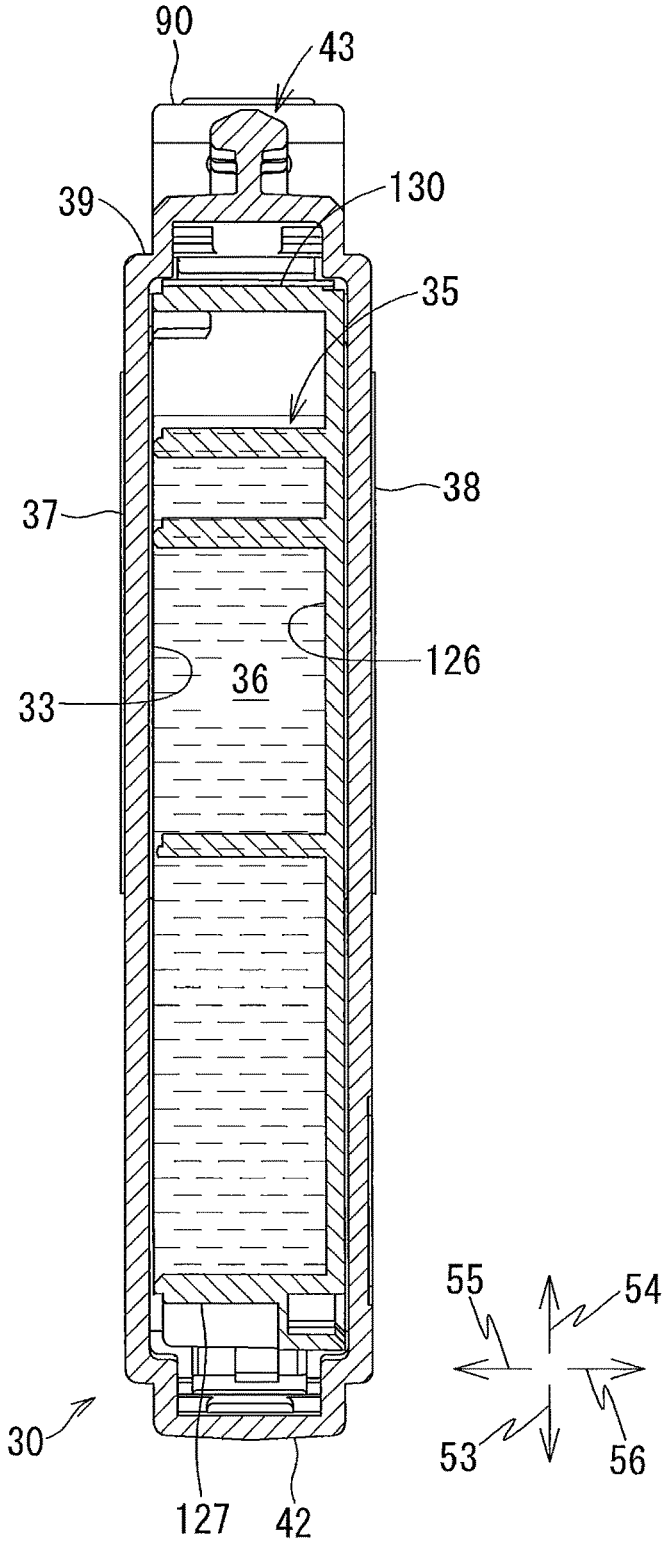
FIG. 5 is a cross-sectional view of the ink cartridge 30 taken along a line V-V in FIG. 4.

The ink cartridge 30 illustrated in FIG. 3 is a container that is configured to store ink therein. As illustrated in FIGS. 4 and 5, a space formed inside the ink cartridge 30 constitutes an ink chamber 36 for storing ink therein. The ink chamber 36 is formed by an inner frame 35 and a film 33. The inner frame 35 defines an internal space serving as the ink chamber 36 in which ink can be stored. When an internal pressure of the ink chamber 36 of the inner frame 35 is reduced in accordance with outflow of ink therefrom, the film 33 deforms such that a volume of the ink chamber 36 is reduced in accordance with reduction of ink in the ink chamber 36. The ink cartridge 30 also includes a rear cover 31 and a front cover 32. The rear cover 31 and the front cover 32 are an example of a casing. The inner frame 35 that defines the ink chamber 36 may also be a part of the casing.

The ink cartridge 30 illustrated in FIGS. 1 and 3 through 5 is in an attached posture or operational posture, that is, a posture of the ink cartridge 30 when the ink cartridge 30 has been completely attached to the cartridge attachment section 110 for use in an image recording operation. As described later in detail, the ink cartridge 30 includes a front wall having a front surface 140, a rear wall having a rear surface 41, upper walls having upper surfaces 39 and 141, lower walls having lower surfaces 42 and 142, right side walls 37 and 143 having right side surfaces, and left side walls 38 and 144 having left side surfaces. In the attached posture of the ink cartridge 30 illustrated in FIGS. 1 and 3 through 5, a direction from the rear surface 41 toward the front surface 140 corresponds to the forward direction 51, a direction from the front surface 140 toward the rear surface 41 corresponds to the rearward direction 52, a direction from the upper surfaces 39 and 141 toward the lower surfaces 42 and 142 corresponds to the downward direction 53, and a direction from the lower surfaces 42 and 142 toward the upper surfaces 39 and 141 corresponds to the upward direction 54. In the attached posture of the ink cartridge 30, the downward direction 53 and the upward direction 54 are parallel to the gravitational direction. Further, when the ink cartridge 30 is inserted into the cartridge attachment section 110 and attached to the cartridge attachment section 110, the front surface 140 faces in the forward direction 51, the rear surface 41 faces in the rearward direction 52, the right side surfaces of the right side walls 37 and 143 face in the rightward direction 55, the left side surfaces of the left side walls 38 and 144 face in the leftward direction 56, the lower surfaces 42 and 142 faces in the downward direction 53, and the upper surfaces 39 and 141 face in the upward direction 54. The forward direction 51 is a direction that the ink cartridge 30 is inserted into the cartridge attachment section 110, while the rearward direction 52 is a direction that the ink cartridge 30 is removed from the cartridge attachment section 110. The forward direction 51 and the rearward direction 52 cross the gravitational direction.

As illustrated in FIGS. 3 through 5, the ink cartridge 30 includes the rear cover 31 that is substantially rectangular parallelepiped-shaped, the front cover 32 a part of which constitutes the front surface 140, and the inner frame 35 defining the ink chamber 36 and an ink channel 44. The rear cover 31 and the front cover 32 in combination provide an external shape of the ink cartridge 30. The inner frame 35 is accommodated inside the rear cover 31 and the front cover 32. The ink cartridge 30 has an overall flattened shape such that a dimension of the ink cartridge 30 in the rightward direction 55 and the leftward direction 56 is narrow, and a dimension of the ink cartridge 30 in the downward direction 53 and the upward direction 54 and a dimension of the ink cartridge 30 in the forward direction 51 and the rearward direction 52 are greater than the dimension of the ink cartridge 30 in the rightward direction 55 and the leftward direction 56. The rear surface 41 of the rear cover 31 is disposed such that the ink chamber 36 is interposed between the rear surface 41 and the front surface 140 of the front cover 32.

Outer surfaces of the ink cartridge 30 are formed of substantially six surfaces, that is, the front surface 140, the rear surface 41, the upper surfaces 39 and 141, the lower surfaces 42 and 142, the right side surfaces of the right side walls 37 and 143, and the left side surfaces of the left side walls 38 and 144. Of the six surfaces, the right side surfaces of the right side walls 37 and 143 and the left side surfaces of the left side walls 38 and 144 are the greatest in area. The front surface 140 and the rear surface 41 are surfaces that expand in the upward direction 54, the downward direction 53, the rightward direction 55, and the leftward direction 56. The upper surfaces 39 and 141 and the lower surfaces 42 and 142 are surfaces that expand in the forward direction 51, the rearward direction 52, the rightward direction 55, and the leftward direction 56. The right side surfaces of the right side walls 37 and 143 and the left side surfaces of the left side walls 38 and 144 are surfaces that expand in the forward direction 51, the rearward direction 52, the upward direction 54, and the downward direction 53.

Each of the front surface, the rear surface, the upper surface, the lower surface, the right side surface, and the left side surface of the ink cartridge 30 does not necessarily form one flat surface. That is, the front surface is a surface(s) of the ink cartridge 30 that is visible when the ink cartridge 30 is viewed in the rearward direction 52 and that is positioned further in the forward direction 51 (i.e. forward) relative to a center portion of the ink cartridge 30 in the forward direction 51 and the rearward direction 52. The rear surface is a surface(s) of the ink cartridge 30 that is visible when the ink cartridge 30 is viewed in the forward direction 51 and that is positioned further in the rearward direction 52 (i.e. rearward) relative to the center portion of the ink cartridge 30 in the forward direction 51 and the rearward direction 52. The upper surface is a surface(s) of the ink cartridge 30 that is visible when the ink cartridge 30 is viewed in the downward direction 53 and that is positioned further in the upward direction 54 (i.e. upward) relative to a center portion of the ink cartridge 30 in the downward direction 53 and the upward direction 54. The lower surface is a surface(s) of the ink cartridge 30 that is visible when the ink cartridge 30 is viewed in the upward direction 54 and that is positioned further in the downward direction 53 (i.e. downward) relative to the center portion of the ink cartridge 30 in the downward direction 53 and the upward direction 54. The same applies to the right side surface and the left side surface. The right side surface is a surface(s) of the ink cartridge 30 that is visible when the ink cartridge 30 is viewed in the leftward direction 56 and that is positioned further in the rightward direction 55 (i.e. rightward) relative to a center portion of the ink cartridge 30 in the rightward direction 55 and the leftward direction 56. The left side surface is a surface(s) of the ink cartridge 30 that is visible when the ink cartridge 30 is viewed in the rightward direction 55 and that is positioned further in the leftward direction 56 (i.e. leftward) relative to the center portion of the ink cartridge 30 in the rightward direction 55 and the leftward direction 56.

In the embodiment, the upper surface 39 positioned further in the rearward direction 52 (i.e. rearward) relative to the upper surface 141 is positioned higher than the upper surface 141. However, the upper surface 39 and the upper surface 141 may be disposed at the same height, that is, the same position in the downward direction 53 and the upward direction 54.

<Rear Cover 31>

As illustrated in FIG. 3, the rear cover 31 is formed in a box-like shape having one end that opens in the forward direction 51. Specifically, the rear cover 31 includes the right side wall 37 having the right side surface, the left side wall 38 having the left side surface, the upper wall having the upper surface 39, the rear wall having the rear surface 41, and the lower wall having the lower surface 42. The rear cover 31 is configured such that the right side surface of the right side wall 37 and the left side surface of the left side wall 38 are arranged spaced apart from each other in the rightward direction 55 and the leftward direction 56, the upper surface 39 faces in the upward direction 54, and the lower surface 42 faces in the downward direction 53, and the right side surface of the right side wall 37, the left side surface of the left side wall 38, the upper surface 29 and the lower surface 42 extend from the rear surface 41 in the forward direction 51. The inner frame 35 is inserted into the rear cover 31 through the front opening of the rear cover 31. That is, the rear cover 31 covers a rear portion of the inner frame 35.

A locking portion 43 is provided at the rear cover 31 above the upper surface 39 of the rear cover 31. The locking portion 43 protrudes in the upward direction 54. The locking portion 43 extends in the forward direction 51 and the rearward direction 52 above the upper surface 39. The locking portion 43 has a surface facing in the rearward direction 52 that serves as a locking surface 171. The locking surface 171 extends in the downward direction 53 and the upward direction 54. The locking surface 171 is a surface capable of contacting the locking rod 145 of the cartridge attachment section 110 rearward in the rearward direction 52 when the ink cartridge 30 has been attached to the cartridge attachment section 110. When the locking surface 171 contacts the locking rod 145 rearward in the rearward direction 52, the locking portion 43 and the locking rod 145 are engaged with each other. As a result, the ink cartridge 30 is retained in the cartridge attachment section 110.

The locking portion 43 also has an inclined surface 175 at a position further in the forward direction 51 (i.e. forward) relative to the locking surface 171. The inclined surface 175 faces in the upward direction 54 and the forward direction 51.

An operation portion 90 is provided on the upper surface 39 of the rear cover 31 at a position further in the rearward direction 52 (i.e. rearward) relative to the locking surface 171. In a state where the ink cartridge 30 is attached to the cartridge attachment section 110, the user operates the operation portion 90 to remove the ink cartridge 30 from the cartridge attachment section 110.

The rear cover 31 further includes a right wall 46 and a left wall 47.

The right wall 46 is provided on the upper surface 39 of the rear cover 31 at a position further in the rightward direction 55 (i.e. rightward) relative to the locking portion 43, and extends from the upper surface 39 in the upward direction 54. The right wall 46 has an outer surface facing in the rightward direction 55, and the outer surface expands in the forward direction 51, the rearward direction 52, the downward direction 53, and the upward direction 54.

The left wall 47 is provided on the upper surface 39 at a position further in the leftward direction 56 (i.e. leftward) relative to the locking portion 43, and extends from the upper surface 39 in the upward direction 54. The left wall 47 has an outer surface facing in the leftward direction 56, and the outer surface expands in the forward direction 51, the rearward direction 52, the downward direction 53, and the upward direction 54.

The right wall 46 and the left wall 47 are arranged spaced apart from each other in the rightward direction 55 and the leftward direction 56. A space is formed between the right wall 46 and the left wall 47. The space formed between the right wall 46 and the left wall 47 is open in the forward direction 51.

The right wall 46 and an upper portion of the right side wall 37 are an example of a wall of the casing. The left wall 47 and an upper portion of the left side wall 38 are an example of the wall of the casing.

As illustrated in FIG. 4, a support shaft 48 as an example of a support member is provided at a position below the upper surface 39 between the right side wall 37 and the left side wall 38. In other words, the support shaft 48 is provided at a position higher than (i.e. further upward relative to) the upper surface 141 of the front cover 32. The support shaft 48 extends in the rightward direction 55 and the leftward direction 56. Right and left ends of the support shaft 48 are supported by the upper portion of the right side wall 37 and the upper portion of the left side wall 38, respectively. A movable member 91 (described above) is pivotally movably supported by the support shaft 48. The position of the right side wall 37 and the left side wall 38 in the forward direction 51 and the rearward direction 52 overlaps the position of the support shaft 48 in the forward direction 51 and the rearward direction 52. In other words, the right side wall 37 and the left side wall 38 overlap the support shaft 48 as viewed in the rightward direction 55 and the leftward direction 56. Further, an upper end of the right wall 46 and an upper end of the left wall 47 are positioned higher than (i.e. further upward relative to) the support shaft 48. A relationship between the right side wall 37, the left side wall 38, the right wall 46, the left wall 47, and the movable member 91 will be described later in detail.

<Front Cover 32>

As illustrated in FIG. 3, the front cover 32 is formed in a box-like shape having one end that opens in the rearward direction 52. Specifically, the front cover 32 includes the front wall having the front surface 140, the upper wall having the upper surface 141, the lower wall having the lower surface 142, the right side wall 143 having the right side surface, and the left side wall 144 having the left side surface. The front cover 32 is configured such that the right side surface of the right side wall 143 and the left side surface of the left side wall 144 are arranged spaced apart from each other in the rightward direction 55 and the leftward direction 56, the upper surface 141 and the lower surface 142 are arranged spaced apart from each other in the downward direction 53 and the upward direction 54, the right side surface of the right side wall 143, the left side surface of the left side wall 144, the upper surface 141, and the lower surface 142 extend from the front surface 140 in the rearward direction 52. The inner frame 35 is inserted into the front cover 32 through the rear opening of the front cover 32. That is, the front cover 32 covers a front portion of the inner frame 35 that is not covered with the rear cover 31.

The right side wall 37 of the rear cover 31 extend further in the upward direction 54 (i.e. upward) relative to the upper surface 141 of the front cover 32, and the right wall 46 extends further in the upward direction 54 (i.e. upward) relative to the right side wall 37. The left side wall 38 of the rear cover 31 extend further in the upward direction 54 (i.e. upward) relative to the upper surface 141 of the front cover 32, and the left wall 47 extends further in the upward direction 54 (i.e. upward) relative to the right side wall 37. That is, the right wall 46 and the upper portion of the right side wall 37 extend in the upward direction 54 from the upper surface 141. Further, the left wall 47 and the upper portion of the left side wall 38 extend in the upward direction 54 from the upper surface 141.

A hole 97 is formed in the front wall constituting the front surface 140 of the front cover 32 at a lower portion thereof. The hole 97 penetrates the front wall of the front cover 32 in the rearward direction 52. The hole 97 allows the ink supply portion 34 of the inner frame 35 to be exposed to an outside in a state where the inner frame 35 is inserted into the front cover 32. Hence, the hole 97 is formed so as to have a position, a dimension, and a shape corresponding to the ink supply portion 34. The ink supply portion 34 is thus disposed at the front surface 140 of the front cover 32.

As illustrated in FIG. 3, an elongated hole 79 is formed in the upper wall constituting the upper surface 141 of the front cover 32. The elongated hole 79 extends in the forward direction 51 and the rearward direction 52. A deformable member 58 (described later) protrudes further in the upward direction 54 (i.e. upward) relative to the upper surface 141 of the front cover 32, through the elongated hole 79, from a position further in the downward direction 53 (i.e. downward) relative to the upper surface 141 of the front cover 32. The elongated hole 79 is an example of an opening.

As illustrated in FIG. 3, a light blocking wall 80 is formed on the upper surface 141 of the front cover 32 at a position closer to the front surface 140 than the elongated hole 79 to the front surface 140. The light blocking wall 80 protrudes upward from the upper surface 141 and extends in the rightward direction 55 and the leftward direction 56. A center portion of the light blocking wall 80 in the rightward direction 55 and the leftward direction 56 is continuous to an identification rib 81 described later.

Further, the IC board 66 is provided on the upper surface 141 of the front cover 32 at a position further in the forward direction 51 (i.e. forward) relative to the movable member 91. A plurality of electrodes (not illustrated) is provided on an upper surface of the IC board 66. The plurality of electrodes each extends in the forward direction 51 and the rearward direction 52 on the upper surface of the IC board 66, and is arranged spaced apart from one another in the leftward direction 56 and the rightward direction 55. The electrodes include a HOT electrode, a GND electrode, a signal electrode, and the like, for example. An IC (not illustrated) provided on the IC board 66 is electrically connected to each of the electrodes. The IC is a semiconductor integrated circuit that stores data indicative of information of the ink cartridge 30 (type information) such as a lot number and manufactured date, for example, in a readable format. In a state where the ink cartridge 30 is attached to the cartridge attachment section 110, the IC is electrically connected to the controller 1 (see FIGS. 1 and 10) of the printer 10 through the respective electrodes. The controller 1 determines the type of the ink cartridge 30 and the like based on data read from the IC board 66.

As illustrated in FIG. 3, the identification rib 81 is provided on the upper surface 141 of the front cover 32 at a position further in the rearward direction 52 (i.e. rearward) relative to the IC board 66, that is, a position closer to the rear surface 41 of the rear cover 31 than the IC board 66 to the rear surface 41. The identification rib 81 is an example of a configuration whose transmission properties of light emitted from the optical sensor 123 differ depending on the type of the ink cartridge 30. The identification rib 81 is positioned further in the rearward direction 52 (i.e. rearward) relative to the ink supply part 34 and further in the forward direction 51 (i.e. forward) relative to the light blocking wall 80.

The identification rib 81 illustrated in FIG. 3 as an identification portion has a light blocking portion 82 and a through hole 83. The identification rib 81 protrudes in the upward direction 54 from the upper surface 141 and extends in the forward direction 51 and the rearward direction 52. The identification rib 81 has a thin plate shape whose dimension in the leftward direction 56 and the rightward direction 55 is narrow. The through hole 83 is formed near a center of the identification rib 81 in the forward direction 51 and the rearward direction 52 and penetrates the identification rib 81 in the leftward direction 56 and the rightward direction 55.

Figure 8:
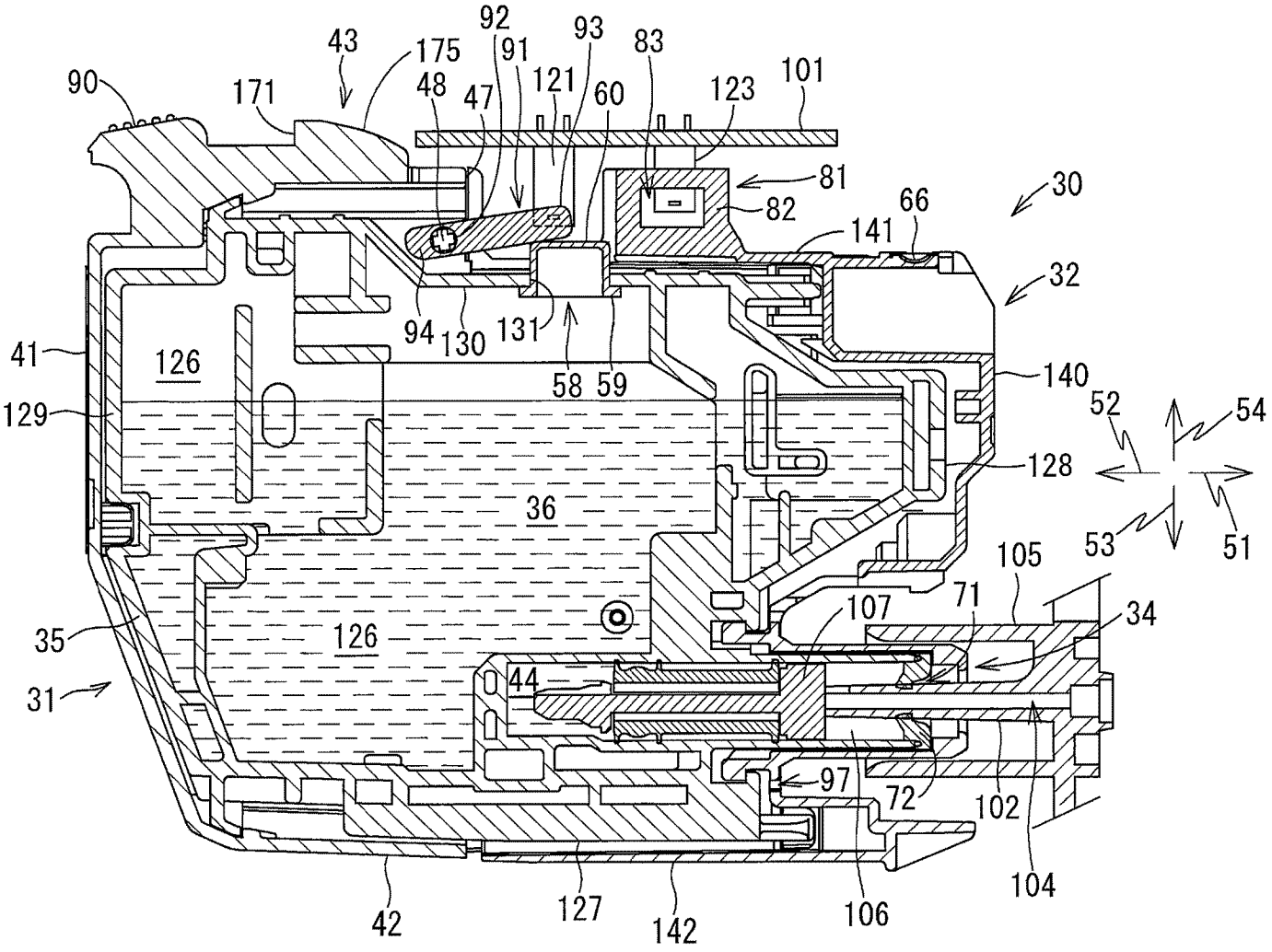
FIG. 8 is a vertical cross-sectional view illustrating a positional relationship of the ink cartridge 30 relative to the optical sensors 121 and 123 in a state where the ink cartridge 30 is completely attached to the cartridge attachment section 110, in which the detection portion 93 of the movable member 91 is at the first position and blocks light emitted from the optical sensor 121.

During the process of the ink cartridge 30 being inserted into the cartridge attachment section 110, the identification rib 81 enters into a gap between the light emitting part and the light receiving part of the optical sensor 123, and blocks or attenuates infrared light emitted from the light emitting part of the optical sensor 123. When the ink cartridge 30 has been completely attached to the cartridge attachment section 110 as illustrated in FIG. 8, the through hole 83 of the identification rib 81 is positioned between the light emitting part and the light receiving part of the optical sensor 123. Infrared light emitted from the light emitting part of the optical sensor 123 passes through the through hole 83 and reaches the light receiving part without being blocked or attenuated by the identification rib 81. The through hole 83 may be formed or may not be formed in the identification rib 81 depending on the type of the ink cartridge 30. When an ink cartridge 30 including an identification rib 81 where the through hole 83 is not formed, that is, a light blocking portion 82 is formed along the entire dimension of the identification rib 81 in an insertion direction (i.e. forward direction 51) is attached to the cartridge attachment section 110, the light blocking portion 82 of the identification rib 81 is positioned between the light emitting part and the light receiving part of the optical sensor 123 and blocks or attenuates infrared light emitted from the light emitting part of the optical sensor 123. With the identification rib 81 having these configurations, the controller 1 detects through the optical sensor 123 whether the through hole 83 of the identification rib 81 is present, and determines the type of the ink cartridge 30.

<Inner Frame 35>

The inner frame 35 is made of a resin. The inner frame 35 is formed in a box-like shape whose right end is open. As illustrated in FIG. 4, the inner frame 35 includes a left wall 126, a lower wall 127, a front wall 128, a rear wall 129, and an upper wall 130. As illustrated in FIG. 5, the open right end of the inner frame 35 is sealed with the film 33, thereby forming the ink chamber 36 that is capable of storing ink therein.

The left wall 126 expands in the forward direction 51, the rearward direction 52, the upward direction 54, and the downward direction 53. The lower wall 127 protrudes in the rightward direction 55 from a lower end portion of the left wall 126. The lower wall 127 expands in the forward direction 51, the rearward direction 52, the rightward direction 55, and the leftward direction 56.

The front wall 128 protrudes in the rightward direction 55 from a front end portion of the left wall 126. The rear wall 129 protrudes in the rightward direction 55 from a rear end portion of the left wall 126. That is, the rear wall 129 is spaced apart from the front wall 128 in the rearward direction 52. Further, the ink chamber 36 is disposed between the front wall 128 and the rear wall 129. The upper wall 130 protrudes in the rightward direction 55 from an upper end portion of the left wall 126. The upper wall 130 is positioned between the front wall 128 and the rear wall 129. An upper end portion of the front wall 128 is connected to the upper wall 130. An upper end portion of the rear wall 129 is connected to the upper wall 130. A lower end portion of the front wall 128 is connected to the lower wall 127. A lower end portion of the rear wall 129 is connected to the lower wall 127.

The front wall 128 and the rear wall 129 expand in the rightward direction 55, the leftward direction 56, the upward direction 54, and the downward direction 53. The upper wall 130 expands in the forward direction 51, the rearward direction 52, the rightward direction 55, and the leftward direction 56.

The ink chamber 36 is defined by the left wall 126, the lower wall 127, the front wall 128, the rear wall 129, the upper wall 130, and the film 33.

The ink chamber 36 communicates with an outside thereof through the ink supply port 71 only. In other words, other than the ink supply port 71 of the ink supply portion 34, the ink cartridge 30 has no air passage through which the ink chamber 36 communicates with ambient air. Hence, when ink stored in the ink chamber 36 flows into the ink tube 20 through the ink needle 102 while the ink needle 102 is in connection with the ink supply portion 34, an internal pressure of the ink chamber 36 is reduced.

The inner frame 35 may include a right wall instead of the left wall 126. In this case, the inner frame 35 may have an open left end, and the open left end may be sealed with the film 33. Further, the inner frame 35 may include a right wall in addition to the left wall 126. That is, at least one of a right wall and a left wall that are side walls defining a right end and a left end of the ink chamber 36 may be made of a resin.

The upper wall 130 has a through hole 131 (an example of a communication channel). The through hole 131 has a circular shape in a plan view. However, the through hole 131 may have a shape other than the circular shape. The through hole 131 penetrates the upper wall 130 and extends in the upward direction 54 and the downward direction 53. The deformable member 58 (described later) is fitted with the through hole 131. Hence, the deformable member 58 liquid-tightly seals the through hole 131.

<Ink Supply Portion 34>

As illustrated in FIG. 3, the ink supply portion 34 (an example of a liquid supply portion) is disposed at a lower portion of the front wall 128 and protrudes in the forward direction 51. The ink supply portion 34 is formed in a substantially cylindrical shape. The ink supply portion 34 has a front end in which the ink supply port 71 is formed. The ink supply port 71 provides communication between an internal space 106 of the ink supply portion 34 and the outside of the ink cartridge 30. An opening (not illustrated) is formed in a rear end of the ink supply portion 34. The opening provides communication between the internal space 106 and the ink chamber 36.

The ink supply portion 34 is provided with a valve 107. The valve 107 is disposed in the internal space 106. The valve 107 is urged in the forward direction 51 by a coil spring (not illustrated). As the coil spring urges the valve 107, the valve 107 contacts an annular-shaped seal member 72 provided in the ink supply port 71 and closes the ink supply port 71. Accordingly, ink in the ink channel 44 is prevented from leaking out of the ink cartridge 30 through the ink supply port 71. The ink channel 44 is in communication with the ink chamber 36 such that ink can flow into the ink channel 44 from the ink chamber 36.

During the process of the ink cartridge 30 being inserted into the cartridge attachment section 110 in the forward direction 51, the ink needle 102 (see FIG. 2) enters into the internal space 106 of the ink supply portion 34 through the ink supply port 71 and pushes the valve 107. The valve 107 is thus moved in the rearward direction 52 against an urging force of the coil spring. As a result, ink in the ink channel 44 flows into the ink tube 20 connected to the ink needle 102 through the internal space 106 of the ink supply portion 34 and the internal space 104 (see FIG. 2) of the ink needle 102.

Incidentally, an opening (not illustrated) is formed at a side surface of the ink needle 102. Ink in the internal space 106 of the ink supply portion 34 can flow into the internal space 104 through the opening of the ink needle 102. Further, the ink needle 102 has a diameter greater than an inner diameter of the seal member 72. The ink needle 102 is inserted into the seal member 72 while pushing the seal member 72 radially outward. No gap is thus formed between the ink needle 102 and the seal member 72 in a state where the ink needle 102 enters into the seal member 72. Therefore, leakage of ink between the ink needle 102 and the seal member 72 can be prevented.

The ink supply portion 34 is not limited to a structure including the valve 107. For example, the ink supply port 71 may be closed by a film. In this case, when the ink cartridge 30 is attached to the cartridge attachment section 110, the ink needle 102 pierces through the film. Accordingly, a tip end portion of the ink needle 102 enters into the internal space 106 of the ink supply portion 34 through the ink supply port 71.

<Deformable Member 58>

The deformable member 58 is made of an elastic material, such as silicone, rubber, or the like. As illustrated in FIG. 4, the deformable member 58 includes a disc-shaped base portion 59 and a bulging portion 60 that bulges from one end of the base portion 59 and has a dome-like shape. The base portion 59 has an outer diameter greater than a diameter of the through hole 131. The bulging portion 60 has an outer diameter slightly greater than the diameter of the through hole 131. The bulging portion 60 is inserted into the through hole 131 in the upward direction 54 from a position below the through hole 131, and the base portion 59 is brought into intimate contact with part of the upper wall 130 defining the through hole 131, whereby the deformable member 58 is attached to the upper wall 130.

In a state where the deformable member 58 is attached to the upper wall 130, the bulging portion 60 bulges (inflates) further in the upward direction 54 (i.e. upward) relative to the upper wall 130. In other words, the bulging portion 60 protrudes higher than (i.e. further upward relative to) the upper surface 141 of the front cover 32. The bulging portion 60 has an internal space that is in communication with the ink chamber 36 through the through hole 131. When the internal pressure of the ink chamber 36 is reduced, the bulging portion 60 is pulled in the downward direction 53 and is elastically deformed such that a volume of the internal space of the bulging portion 60 is reduced. Alternatively, the bulging portion 60 is elastically deformed such that the volume of the internal space of the bulging portion 60 is reduced as an urging force or a pressing force of the movable member 91 in the downward direction 53 becomes greater than an internal pressure of the bulging portion 60 in accordance with reduction of the internal pressure of the ink chamber 36. In other words, the bulging portion 60 is elastically deformed such that inflation (i.e. distension) of the bulging portion 60 in the upward direction 54 is reduced in accordance with reduction in the internal pressure of the ink chamber 36. Note that the ink chamber 36 and the internal space of the bulging portion 60 can communicate with an outside of the ink cartridge 30 only through the ink supply portion 34 when the ink cartridge 30 has been attached to the cartridge attachment section 110.

The deformable member 58 is a film made of a synthetic resin. That is, the deformable member 58 is made of an elastic material. The hardness of the deformable member 58 is higher than the hardness of the film 33 attached to the inner frame 35. That is, when the internal pressure of the ink chamber 36 is reduced, the film 33 is deformed so as to be bent inward before the deformable member 58 is deformed. Further, the hardness of the deformable member 58 is set such that the deformable member 58 is not deformed by the weight of the movable member 91.

<Movable Member 91>

As illustrated in FIG. 4, the movable member 91 is pivotally supported by the support shaft 48. The movable member 91 is formed in an elongated flat plate shape whose longitudinal direction is aligned in the in the forward direction 51 and the rearward direction 52. The movable member 91 is pivotally movable about the support shaft 48 serving as a pivot center while a pair of largest surfaces of the movable member 91 faces in the rightward direction 55 and the leftward direction 56. The movable member 91 has a through hole 92 through which the support shaft 48 is inserted, a detection portion 93, and a stopper 94.

In the movable member 91, the detection portion 93 is provided at a position further in the forward direction 51 (i.e. forward) relative to the support shaft 48. The detection portion 93 is positioned on and in contact with the deformable member 58. The detection portion 93 may be disposed on only a part of the deformable member 58. That is, the detection portion 93 is disposed such that at least a part of the detection portion 93 overlaps the deformable member 58 in a plan view. Note that the detection portion 93 may be disposed above the deformable member 58, and may not necessarily be in direct contact with the deformable member 58 as long as the detection portion 93 can change its position in accordance with deformation of the deformable member 58. Hence, the detection portion 93 is positioned further in the upward direction 54 (i.e. upward) relative to the deformable member 58.

The detection portion 93 is adapted to be detected by blocking or attenuating light emitted from an outside (i.e. the optical sensor 121). More specifically, when light outputted from the light emitting part of the optical sensor 121 reaches one of left and right surfaces of the detection portion 93, intensity (transmission state) of light passing through the other surface of the left and right surfaces of the detection portion 93 and reaching the light receiving part of the optical sensor 121 becomes less than a prescribed intensity, e.g., 0 (zero). The detection portion 93 may completely block the light traveling in the rightward direction 55 or the leftward direction 56, may partially absorb the light, may deflect the light, or may fully reflect the light.

In this embodiment, surfaces of the detection portion 93 facing in the rightward direction 55 and the leftward direction 56 are exposed to an outside so as to be capable of being contacted from an outside. However, the detection portion 93 may be covered with a light transmissive cover allowing light from an outside to transmit therethrough.

Figure 9:
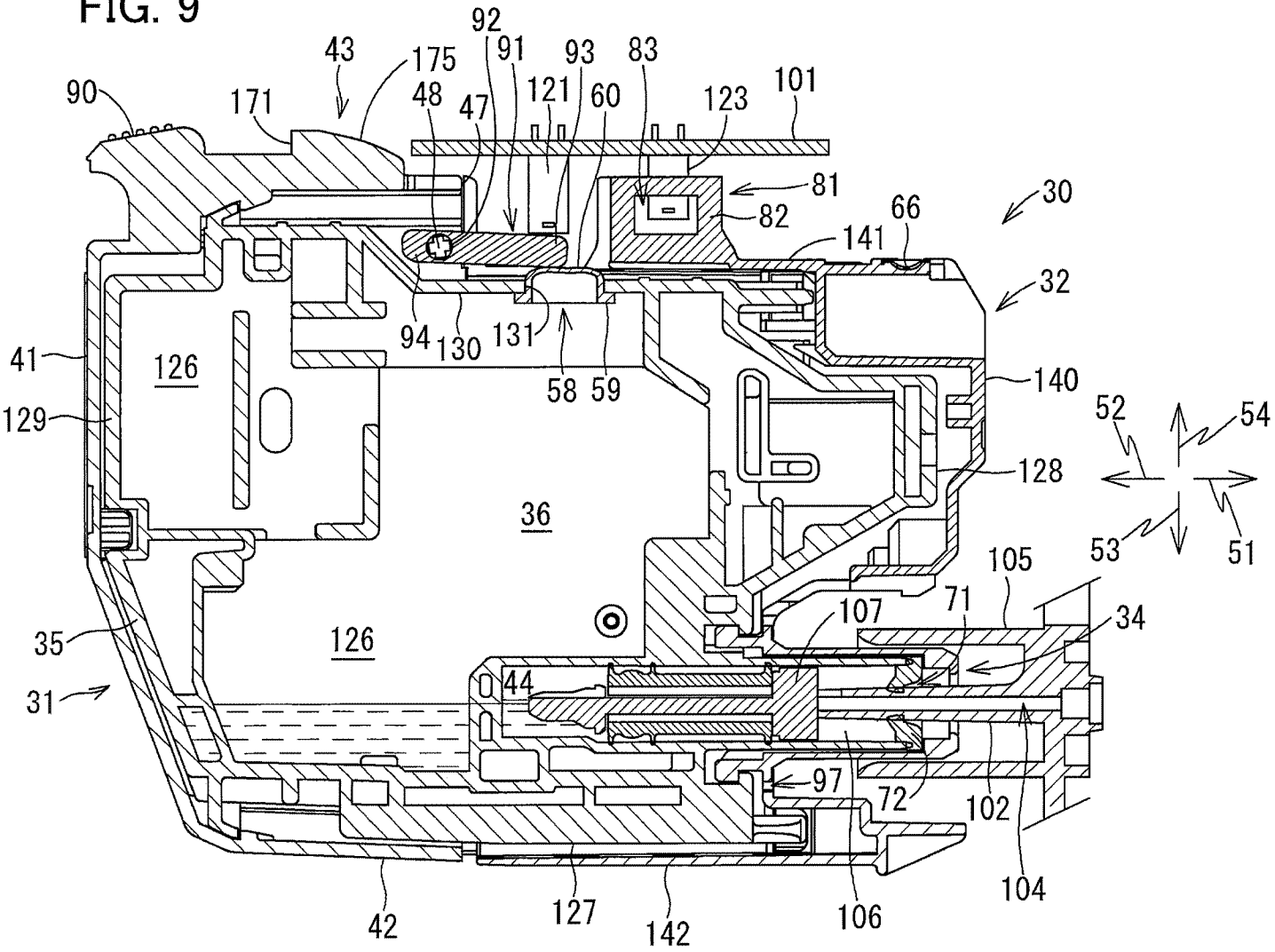
FIG. 9 is a vertical cross-sectional view illustrating a positional relationship of the ink cartridge 30 relative to the optical sensors 121 and 123 in a state where the ink cartridge 30 is completely attached to the cartridge attachment section 110, in which the detection portion 93 of the movable member 91 is at a second position and does not block light emitted from the optical sensor 121.

In the movable member 91, the stopper 94 is provided at a position further in the rearward direction 52 (i.e. rearward) relative to the support shaft 48. In other words, the stopper 94 is positioned opposite to the detection portion 93 with respect to the support shaft 48. The stopper 94 is positioned immediately above the upper wall 130 of the inner frame 35. As illustrated in FIG. 8, the stopper 94 is arranged spaced apart from an upper surface of the upper wall 130 when the detection portion 93 is in contact with the deformable member 58 that has not yet been deformed, that is, has bulged (inflated) in the upward direction 54. Note that the position of the detection portion 93 in contact with the deformable member 58 that has not yet been elastically deformed will be referred to as a first position (see FIG. 8). The first position is an example of an upper position. In a state where the detection portion 93 is in contact with the deformable member 58 as illustrated in FIG. 8, the movable member 91 can be pivotally moved in a counterclockwise direction in FIG. 8 such that the detection portion 93 is further moved in the upward direction 54. However, when the detection portion 93 is further moved in the upward direction 54 from the state shown in FIG. 8, the stopper 94 comes into contact with the upper surface of the upper wall 130 of the inner frame 35. As the stopper 94 contacts the upper surface of the upper wall 130, the movable member 91 is restricted from further pivotally moving in the counterclockwise direction in FIG. 8. That is, the stopper 94 is configured to restrict the pivotal movement of the movable member in the counterclockwise direction in FIG. 8. When the deformable member 58 has been deformed so as to deflate in the downward direction 53 as illustrated in FIG. 9, the detection portion 93 is moved in the downward direction 53 by its own weight. Note that the position of the detection portion 93 in contact with the deformable member 58 that has been elastically deformed will be referred to as a second position (see FIG. 9). The second position is an example of a lower position. As a result, the movable member 91 is pivotally moved about the support shaft 48 in a clockwise direction in FIG. 9. That is, the position of the detection portion 93 in the upward direction 54 and the downward direction 53 is changed in accordance with the elastic deformation of the deformable member 58. In other words, the detection portion 93 is configured to move in the upward direction 54 and the downward direction 53 in accordance with the elastic deformation of the deformable member 58. Incidentally, the stopper 94 is not essential for the movable member 91, and thus, the movable member 91 may not be provided with the stopper 94.

As illustrated in FIGS. 3 and 4, the right side wall 37 and the right wall 46 are positioned further in the right direction 55 (i.e. rightward) relative to the movable member 91, and the left side wall 38 and the left wall 47 are positioned further in the leftward direction 56 (i.e. leftward) relative to the movable member 91. A front end of the right side wall 37 and a front end of the right wall 46 are positioned closer to the support shaft 48 than the detection portion 93 to the support shaft 48 in the forward direction 51 and the rearward direction 52. A front end of the left side wall 38 and a front end of the left wall 47 are positioned closer to the support shaft 48 than the detection portion 93 to the support shaft 48 in the forward direction 51 and the rearward direction 52. In other words, the detection portion 93 protrudes in the forward direction 51 from the respective front ends of the right side wall 37, the left side wall 38, the right wall 46, and the left wall 47. That is, no wall is present in the rightward direction 55 and the leftward direction 56 of the detection portion 93.

The light blocking wall 80 is disposed further in the forward direction 51 (i.e. forward) relative to the detection portion 93. However, a space (an example of an opening) elongated in the forward direction 51 and the rearward direction 52 is formed between the light blocking wall 80, and the right side wall 37, the right wall 46, the left side wall 38 and the left wall 47. This space allows the detection portion 93 to be exposed to an outside in the rightward direction 55 and the leftward direction 56. Accordingly, light emitted from the light emitting part of the optical sensor 121 reaches the detection portion 93 at the first position through this space.

Further, the position in the forward direction 51 and the rearward direction 52 of the right wall 46 and the left wall 47 overlaps the position in the forward direction 51 and the rearward direction 52 of the support shaft 48. The position in the forward direction 51 and the rearward direction 52 of the right side wall 37 and the left side wall 38 overlaps the position in the forward direction 51 and the rearward direction 52 of the support shaft 48. In other words, the right side wall 37, the left side wall 38, the right wall 46, and the left wall 47 overlap the support shaft 48 as viewed in the right direction 55 and the leftward direction 56.

Further, the upper end of the right wall 46 and the upper end of the left wall 47 are positioned further in the upward direction 54 (i.e. upward) relative to the support shaft 48. Further, the upper end of the right wall 46 and the upper end of the left wall 47 are positioned further in the upward direction 54 (i.e. upward) relative to the detection portion 93 at the first position.

The support shaft 48 is positioned, in the upward direction 54 and the downward direction 53, between the detection portion 93 at the first position (see FIG. 8) where the detection portion 93 is contact with the deformable member 58 that has not yet been elastically deformed, and the detection portion 93 at the second position (see FIG. 9) where the detection portion 93 is in contact with the deformable member 58 that has been elastically deformed.

<Controller 1>

Figure 10:
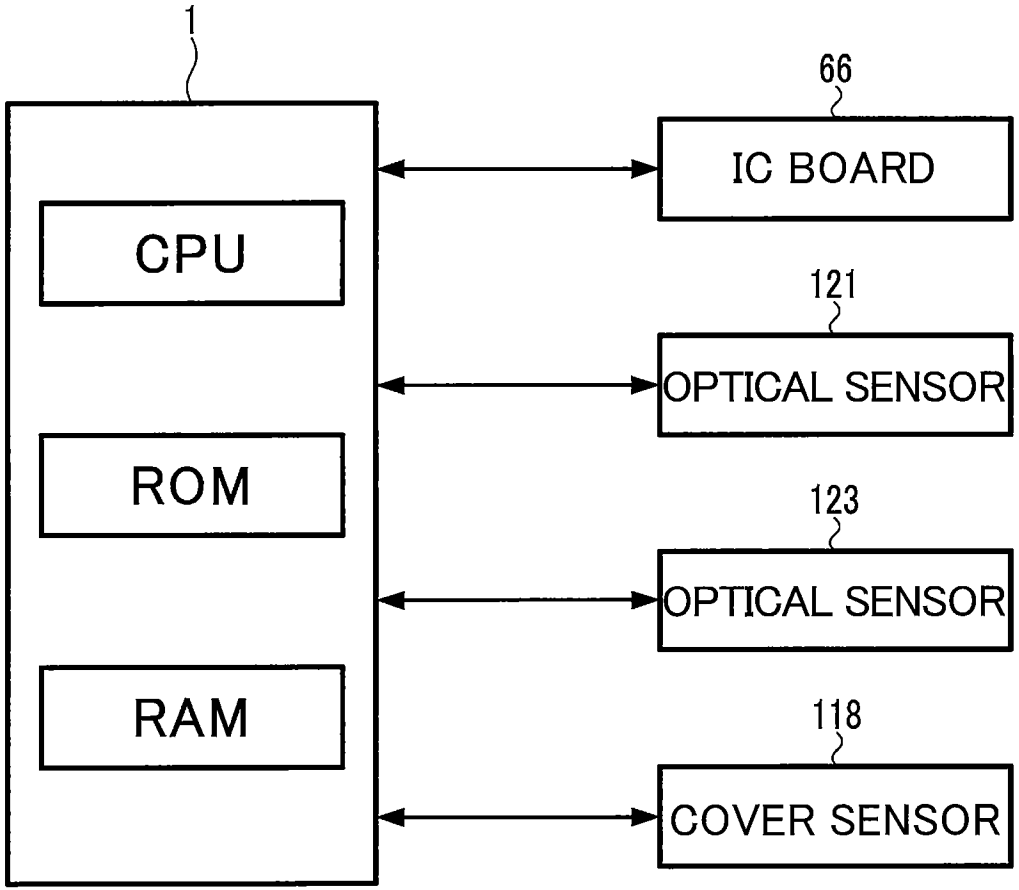
FIG. 10 is a functional block diagram of the printer 10.
Figure 11A:
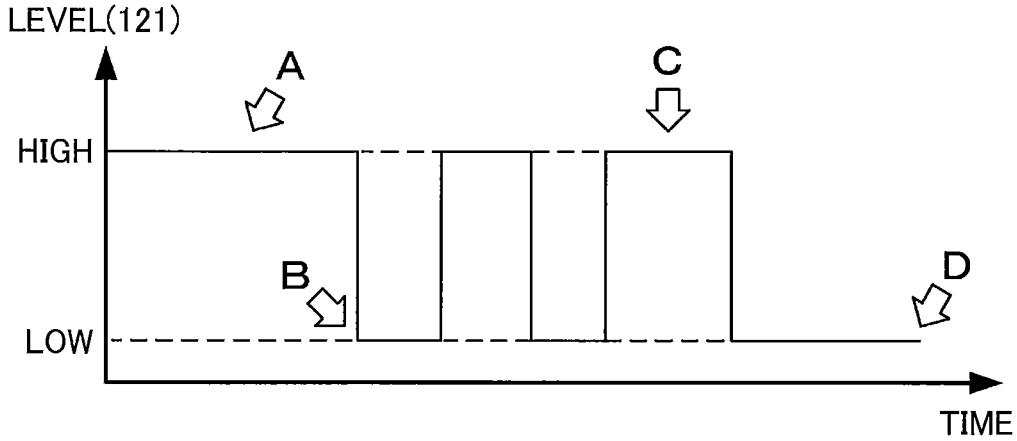
FIG. 11A is a timing chart illustrating changes in signal outputted from the optical sensor 121 during the process of the ink cartridge 30 being inserted into the cartridge attachment section 110.
Figure 11B:
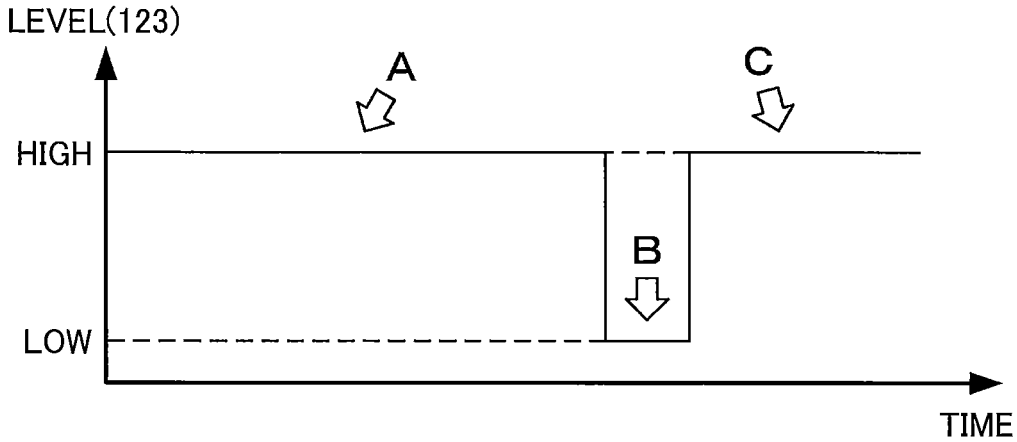
FIG. 11B is a timing chart illustrating changes in signal outputted from the optical sensor 123 during the process of the ink cartridge 30 being inserted into the cartridge attachment section 110.
Figure 11C:
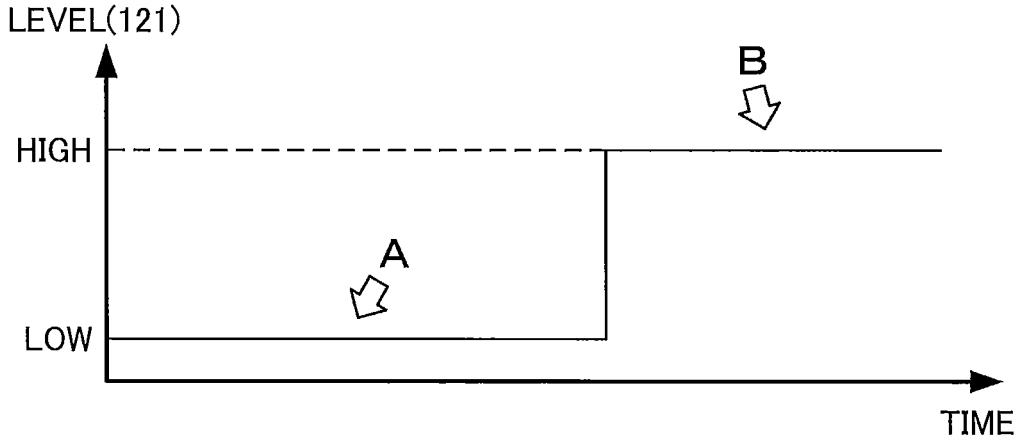
FIG. 11C is a timing chart illustrating a change in signal outputted from the optical sensor 121 during the process of ink stored in the ink cartridge 30 being consumed.

The printer 10 includes the controller 1 illustrated in FIG. 10. The controller 1 includes a CPU, a ROM, a RAM, and the like, for example. The controller 1 may be disposed inside a housing of the printer 10 as a control board for controlling the printer 10 or may be provided in the case 101 as a separate control board that is independent from a controller for the printer 10. The controller 1 is connected to the IC board 66, the optical sensor 121, the optical sensor 123, and the cover sensor 118 so as to be capable of transmitting and receiving electrical signals to and from the IC board 66, the optical sensor 121, the optical sensor 123, and the cover sensor 118. The controller 1 is also connected to other components, such as a motor and a touch screen, so as to be capable of transmitting and receiving electrical signals to and from these components, but these components are omitted in FIG. 10. A program that causes the controller 1 to execute various processes is stored in the ROM. The CPU performs computations and issues commands to the components connected to the controller 1 in order to execute the processes based on the program stored in the ROM. The RAM functions as a memory that temporarily stores various information.

The optical sensor 121 transmits a high level signal to the controller 1 when the light receiving part of the optical sensor 121 receives light emitted in the leftward direction 56 from the light emitting part of the optical sensor 121 to the light receiving part of the optical sensor 121. The optical sensor 121 transmits a low level signal to the controller 1 when the light receiving part of the optical sensor 121 does not receive light emitted in the leftward direction 56 from the light emitting part of the optical sensor 121 to the light receiving part of the optical sensor 121.

The optical sensor 123 transmits a high level signal to the controller 1 when the light receiving part of the optical sensor 123 receives light emitted in the leftward direction 56 from the light emitting part of the optical sensor 123 to the light receiving part of the optical sensor 123. The optical sensor 123 transmits a low level signal to the controller 1 when the light receiving part of the optical sensor 123 does not receive light emitted in the leftward direction 56 from the light emitting part of the optical sensor 123 to the light receiving part of the optical sensor 123.

<Detection of Attachment and Detection of Ink Remaining Amount>

Next, detection of attachment of ink cartridge 30 to the cartridge attachment section 110 with the use of the optical sensor 123 and detection of a remaining amount of ink in the ink chamber 36 with the use of the optical sensor 121 will be described.

In the cartridge attachment section 110 into which the ink cartridge 30 has not yet been inserted as illustrated in FIG. 2, nothing is present between the light emitting part of the optical sensor 121 and the light receiving part of the optical sensor 121, so that light emitted from the light emitting part of the optical sensor 121 is not interrupted. Further, nothing is present between the light emitting part of the optical sensor 123 and the light receiving part of the optical sensor 123, so that light emitted from the light emitting part of the optical sensor 123 is not interrupted. Accordingly, the optical sensor 121 transmits a high level signal to the controller 1 as indicated by an arrow "A" in FIG. 11A. Further, the optical sensor 123 transmits a high level signal to the controller 1 as indicated by an arrow "A" in FIG. 11B.

Further, in the ink cartridge 30 that has not yet been inserted into the cartridge attachment section 110 as illustrated in FIG. 4, the bulging portion 60 of the deformable member 58 protrudes further in the upward direction 54 (i.e. upward) relative to a part of the upper surface of the upper wall 130 through the through hole 131. That is, the bulging portion 60 protrudes further in the upward direction 54 (i.e. upward) relative to the upper surface 141 of the front cover 32. The detection portion 93 is disposed at the first position and in contact with the deformable member 58.

When the ink cartridge 30 is inserted in the forward direction 51 into the cartridge attachment section 110 after the cover of the cartridge attachment section 110 is opened, the inclined surface 175 of the locking portion 43 abuts against the locking rod 145 to be pressed by the locking rod 145. The locking portion 43 is thereby moved in the downward direction 53. When the ink cartridge 30 is inserted further in the forward direction 51, the inclined surface 175 moves past the locking rod 145 in the forward direction 51. The locking portion 43 is no longer pressed by the locking rod 145 at this time. Accordingly, the locking portion 43 is moved in the upward direction 54. As a result, the locking surface 171 faces the locking rod 145 rearward in the rearward direction 52. The ink cartridge 30 is thus fixed in position in the cartridge attachment section 110 and completely attached to the cartridge attachment section 110.

When the ink cartridge 30 is removed from the cartridge attachment section 110 in the rearward direction 52, the operation portion 90 is pressed in the downward direction 53 to move the locking portion 43 in the downward direction 53. Accordingly, the locking surface 171 is positioned further in the downward direction 53 (i.e. downward) relative to the locking rod 145. As a result, the ink cartridge 30 can be removed from the cartridge attachment section 110 without being blocked by the locking rod 145.

Figure 6:
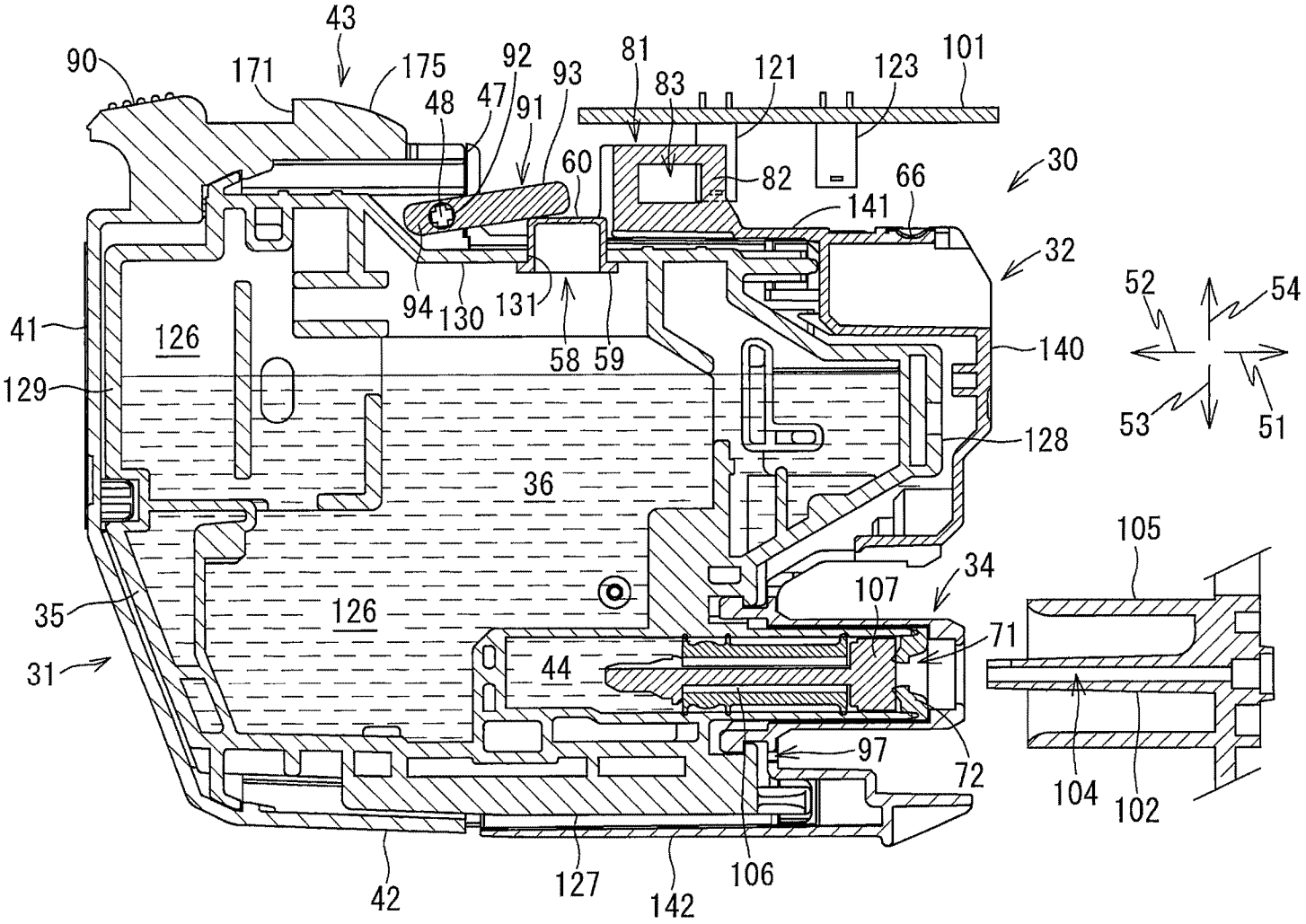
FIG. 6 is a vertical cross-sectional view illustrating a positional relationship of the ink cartridge 30 relative to optical sensors 121 and 123 during the process of the ink cartridge 30 being attached to the cartridge attachment section 110, in which a light blocking portion 82 of an identification rib 81 is located at a position that blocks light emitted from the optical sensor 121.

When the ink cartridge 30 is inserted in the forward direction 51 into the cartridge attachment section 110 as illustrated in FIG. 6, the light blocking portion 82 of the identification rib 81 is positioned between the light emitting part of the optical sensor 121 and the light receiving part of the optical sensor 121. The signal transmitted from the optical sensor 121 to the controller 1 thus changes from a high level signal to a low level signal as indicated by an arrow "B" in FIG. 11A. At this time, no portion of the ink cartridge 30 is present between the light emitting part of the optical sensor 123 and the light receiving part of the optical sensor 123, and hence, light emitted from the light emitting part of the optical sensor 123 is not interrupted. Therefore, the signal transmitted from the optical sensor 123 to the controller 1 remains unchanged, that is, the optical sensor 123 keeps transmitting a high level signal to the controller 1.

Figure 7:
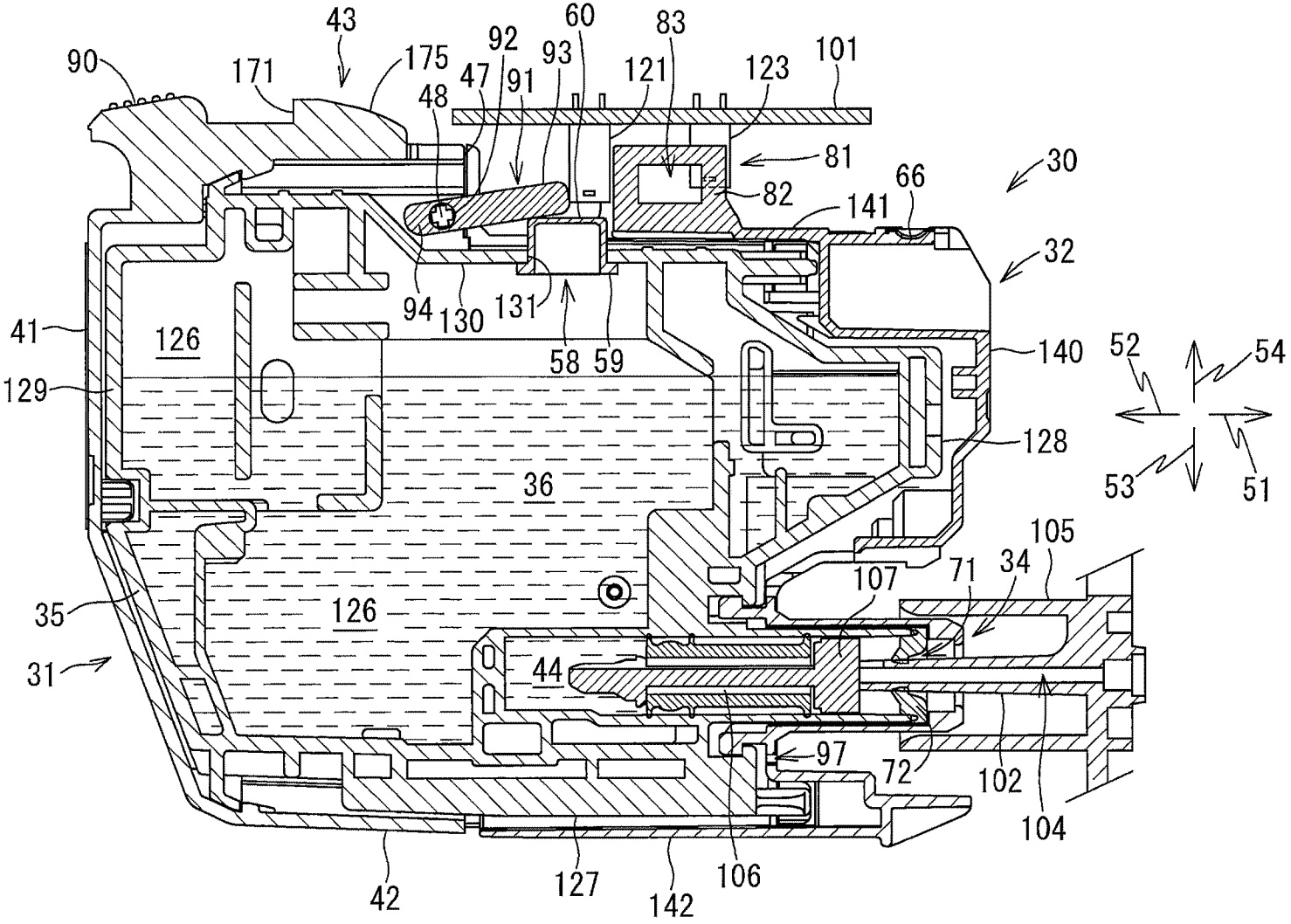
FIG. 7 is a vertical cross-sectional view illustrating a positional relationship of the ink cartridge 30 relative to the optical sensors 121 and 123 during the process of the ink cartridge 30 being attached to the cartridge attachment section 110, in which the light blocking portion 82 of the identification rib 81 is located at a position that blocks light emitted from the optical sensor 123.

When the ink cartridge 30 is further inserted into the cartridge attachment section 110 as illustrated in FIG. 7, the through hole 83 of the identification rib 81 moves past the optical sensor 121 and the identification rib 81 is positioned further in the forward direction 51 (i.e. forward) relative to the optical sensor 121. The signal transmitted from the optical sensor 121 to the controller 1 thus changes from a low level signal to a high level signal, as indicated by an arrow "C" in FIG. 11A. The light blocking portion 82 of the identification rib 81 is positioned between the light emitting part of the optical sensor 123 and the light receiving part of the optical sensor 123. The signal transmitted from the optical sensor 123 to the controller 1 thus changes from a high level signal to a low level signal as indicated by an arrow "B" of FIG. 11B.

When the ink cartridge 30 is further inserted into the cartridge attachment section 110 and the ink cartridge 30 is completely attached to the cartridge attachment section 110, the through hole 83 of the identification rib 81 is positioned between the light emitting part of the optical sensor 123 and the light receiving part of the optical sensor 123, as illustrated in FIG. 8. That is, the through hole 83 of the identification rib 81 allows light emitted from the light emitting part of the optical sensor 123 to pass therethrough. The signal transmitted from the optical sensor 123 to the controller 1 thus changes from a low level signal to a high level signal, as indicated by an arrow "C" in FIG. 11B, after changed from a high level signal to a low level signal.

Further, the detection portion 93 is positioned between the light emitting part of the optical sensor 121 and the light receiving part of the optical sensor 121, and blocks light emitted from the light emitting part of the optical sensor 121. The signal transmitted from the optical sensor 121 to the controller 1 thus changes from a high level signal to a low level signal, as indicated by an arrow "D" in FIG. 11A.

After the ink cartridge 30 is completely attached to the cartridge attachment section 110, the cover of the cartridge attachment section 110 is closed.

During the process of the ink cartridge 30 being inserted into the cartridge attachment section 110, the movable member 91 does not pivotally move. Accordingly, in a state illustrated in FIG. 8, the detection portion 93 is positioned at the first position.

As described above, the detection portion 93 at the first position blocks light emitted in the leftward direction 56 from the optical sensor 121. Further, after the light blocking portion 82 of the identification rib 81 blocks light emitted in the leftward direction 56 from the optical sensor 123, the through hole 83 of the identification rib 81 allows the light to pass therethrough.

Figure 12:
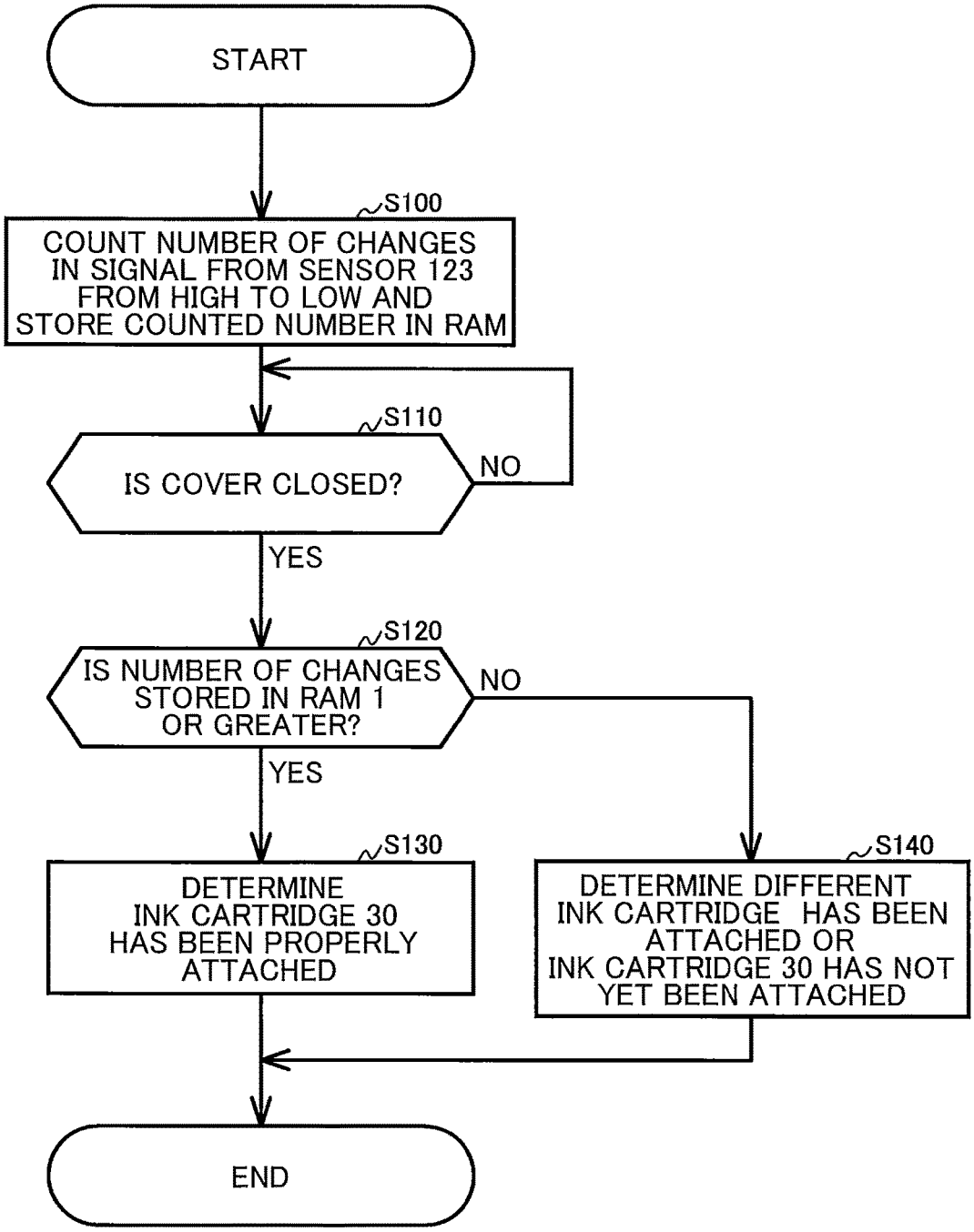
FIG. 12 is a flowchart for explaining a process executed by a controller 1 for determining whether the ink cartridge 30 has been attached to the cartridge attachment section 110.

Next, a process executed by the controller 1 for determining whether the ink cartridge 30 has been attached to the cartridge attachment section 110 will be described with reference to a flowchart in FIG. 12.

The controller 1 counts the number of times of changes in the signal transmitted from the optical sensor 123 to the controller 1 from a high level signal to a low level signal after the cover of the cartridge attachment section 110 is opened and until the cover of the cartridge attachment section 110 is closed, and stores the counted number in the RAM (S100).

Then, the controller 1 determines whether the cover is closed (S110). If the controller 1 determines that the cover is not closed (No in S110), the controller 1 repeats the process in S110. If the controller 1 determines that the cover is closed (Yes in S110), the controller 1 refers to the number of changes stored in the RAM (S120). Then, if the number of changes is 1 or greater (Yes in S120), the controller 1 determines that the ink cartridge 30 has been properly attached to the cartridge attachment section 110 (S130). If the number of changes is zero (No in S120), the controller 1 determines that an ink cartridge different from the ink cartridge 30 has been attached to the cartridge attachment section 110 or the ink cartridge 30 has not been attached to the cartridge attachment section 110 (S140).

Next, how a remaining amount of ink in the ink chamber 36 is detected with the use of the optical sensor 121 will be described.

In a state where a sufficient amount of ink remains in the ink chamber 36, the detection portion 93 is positioned between the light emitting part of the optical sensor 121 and the light receiving part of the optical sensor 121 as illustrated in FIG. 8. Hence, the optical sensor 121 transmits a low level signal to the controller 1 as indicated by an arrow "A" in FIG. 11C.

When ink stored in the ink chamber 36 is consumed and the amount of the ink stored in the ink chamber 36 is reduced from a state illustrated in FIG. 8 to a state illustrated in FIG. 9, the film 33 defining a part of the ink chamber 36 is deformed inward such that the volume of the ink chamber 36 is reduced.

When the ink stored in the ink chamber 36 is further consumed and the amount of the ink stored in the ink chamber 36 is further reduced after the film 33 is deformed to the maximum, the internal pressure of the ink chamber 36 is reduced. In accordance with the reduction in the internal pressure of the ink chamber 36, the bulging portion 60 is elastically deformed so as to deflate in the downward direction 53. As a result, an uppermost end of the bulging portion 60 is moved in the downward direction 53 to the vicinity of the upper surface of the upper wall 130. At this time, the movable member 91 is pivotally moved such that the detection portion 93 is moved in the downward direction 53 by its own weight (gravity), that is, the detection portion 93 is moved from the first position to the second position.

Alternatively, in accordance with the reduction of the internal pressure of the ink chamber 36, an urging force or a pressing force exerted on the bulging portion 60 by the movable member 91 becomes greater than a force allowing the bulging portion 60 to bulge, and the detection portion 93 starts moving in the downward direction 53 such that a lower surface of the movable member 91 compresses the bulging portion 60.

When the detection portion 93 is at the second position, the detection portion 93 is not positioned between the light emitting part of the optical sensor 121 and the light receiving part of the optical sensor 121 as illustrated in FIG. 9. Accordingly, light emitted from the light emitting part of the optical sensor 121 reaches the light receiving part of the optical sensor 121 without being blocked by the detection portion 93. Hence, the signal transmitted from the optical sensor 121 to the controller 1 changes from a low level signal to a high level signal, as indicated by an arrow "B" in FIG. 11C. As a result, the controller 1 detects that an amount of ink remaining in the ink chamber 36 becomes smaller than a predetermined amount.

<Operational Advantages>

According to the above-described embodiment, the deformable member 58 is positioned above the ink chamber 36 in the ink cartridge 30 at the operational posture. Hence, even if ink has flowed into the internal space of the deformable member 58, the ink in the internal space of the deformable member 58 flows back into the ink chamber 36 by gravity. Accordingly, accurate detection of a remaining amount of ink in the ink chamber 36 can be achieved.

Further, the respective front ends of the right side wall 37, the left side wall 38, the right wall 46, and the left wall 47 of the rear cover 31 are closer to the support shaft 48 than the detection portion 93 of the movable member 91 to the support shaft 48 in the forward direction 51 and the rearward direction 52. Hence, the support shaft 48 and a part of the movable member 91 can be protected by the right side wall 37, the left side wall 38, the right wall 46, and the left wall 47.

Further, the right side wall 37, the left side wall 38, the right wall 46, and the left wall 47 are provided at positions overlapping the support shaft 48 with respect to the forward direction 51 and the rearward direction 52. In other words, the right side wall 37, the left side wall 38, the right wall 46, and the left wall 47 overlap the support shaft 48 as viewed in the right direction 55 and the leftward direction 56. Further, the respective upper ends of the right wall 46 and the left wall 47 are positioned above the support shaft 48. Hence, even if the ink cartridge 30 falls with the upper surface 39 of the rear cover 31 facing downward or even if an external force is applied to the upper surface 39 of the rear cover 31, the support shaft 48 is protected by the right wall 46 and the left wall 47. Therefore, damages to the support shaft 48, such as breakage or deformation, can be prevented.

Further, the respective upper ends of the right wall 46 and the left wall 47 are positioned above the detection portion 93 at the first position. Hence, the detection portion 93 is also protected by the right wall 46 and the left wall 47. Accordingly, damages to the detection portion 93, such as breakage or deformation, can also be prevented.

Further, the right side wall 37, the left side wall 38, the right wall 46, and the left wall 47 are positioned rearward of the detection portion 93, while the light blocking wall 80 is positioned forward of the detection portion 93. Hence, the detection portion 93 is more reliably protected. Further, the detection portion 93 can be optically detected in the right direction 55 and the leftward direction 56 through the space formed between the light blocking wall 80, and the right side wall 37, the left side wall 38, the right wall 46, and the left wall 47.

Further, the movable member 91 is pivotally movable about the support shaft 48 serving as the center of the pivotal movement. Hence, smooth movement of the movable member 91 can be realized.

Further, the stopper 94 of the movable member 91 contacts the inner frame 35, thereby restricting the movable member 91 from pivotally moving in a direction in which the detection portion 93 is away from the upper surface 39 of the rear cover 31, that is, in the upward direction 54. This configuration can prevent the detection portion 93 from moving too far away from the upper surface 39.

Further, the support shaft 48 is positioned between the detection portion 93 at the first position and the detection portion 93 at the second position in the upward direction 54 and the downward direction 53. This configuration can improve efficiency of the pivotal movement of the movable member 91 relative to the deformation of the deformable member 58.

<First Modification>

Next, an ink cartridge 230 as a liquid cartridge according to a first modification to the embodiment will be described with reference to FIGS. 13A through 13D, wherein like parts and components are designated by the same reference numerals as those of the above-described embodiment to avoid duplicating description.

The ink cartridge 230 has a structure that can ensure an easy and reliable reduction in an internal pressure of an ink chamber 236 when an amount of ink stored in the ink chamber 236 is being reduced.

As illustrated in FIGS. 13A through 13D, the ink cartridge 230 includes the ink chamber 236, an ink channel 244 and a differential-pressure regulating valve 257. The ink chamber 236 is defined by the inner frame 35 and the film 33, as in the above-described embodiment. Further, the ink chamber 236 is covered by the rear cover 31 and the front cover 32, as in the above-described embodiment.

The ink channel 244 is formed in a front portion of the ink cartridge 230. The ink chamber 236 is formed in a rear portion of the ink cartridge 230.

The ink channel 244 includes a first channel 251 and a second channel 252. The first channel 251 is in communication with the ink supply portion 34. The second channel 252 is formed at a position further in the rearward direction 52 (i.e. rearward) relative to the first channel 251. The second channel 252 is in communication with the first channel 251 through an opening 254, and in communication with a first ink chamber 236A of the ink chamber 236 through an opening 255 and a passage 262. The opening 255 is opened and closed by a spherical body 256 that can move in the upward direction 54 and the downward direction 53.

The ink chamber 236 includes the first ink chamber 236A and a second ink chamber 236B. The second ink chamber 236B is formed at a position further in the rearward direction 52 (i.e. rearward) relative to the second channel 252. The second ink chamber 236B is in communication with the first channel 251 through an opening 258 and a passage 260, and in communication with the first ink chamber 236A through a passage 253. The opening 258 is opened and closed by a spherical body 259 that can move in the upward direction 54 and the downward direction 53.

The differential-pressure regulating valve 257 is provided between the ink chamber 236 and the ink channel 244. The differential-pressure regulating valve 257 allows the ink chamber 236 and the ink channel 244 to communicate with each other based on a difference between pressure inside the ink chamber 236 and pressure inside the ink channel 244.

The differential-pressure regulating valve 257 includes the above-described two spherical bodies 256 and 259. The spherical body 256 is disposed in the second channel 252. The spherical body 256 has a specific gravity that is greater than that of ink. Thus, when the second channel 252 is filled with ink, the spherical body 256 moves (i.e. sinks) in the downward direction 53 to close the opening 255. The spherical body 259 is disposed in the second ink chamber 236B. The spherical body 259 has a specific gravity that is smaller than that of ink. Thus, when the second ink chamber 236B is filled with ink, the spherical body 256 moves (i.e. floats) in the upward direction 54 by a buoyancy force exerted by ink, opening the opening 258.

The deformable member 58 is provided at an upper end portion of the first channel 251. That is, the deformable member 58 is in communication with the ink chamber 236 through the ink channel 244. The movable member 91 and the identification rib 81 are disposed above the upper wall 130. The deformable member 58, the movable member 91, and the identification rib 81 have the same configurations as those of the above-described embodiment, and thus, descriptions thereof will be omitted.

Next, an operation of the differential-pressure regulating valve 257 according to this modification will be described.

Figure 13A:
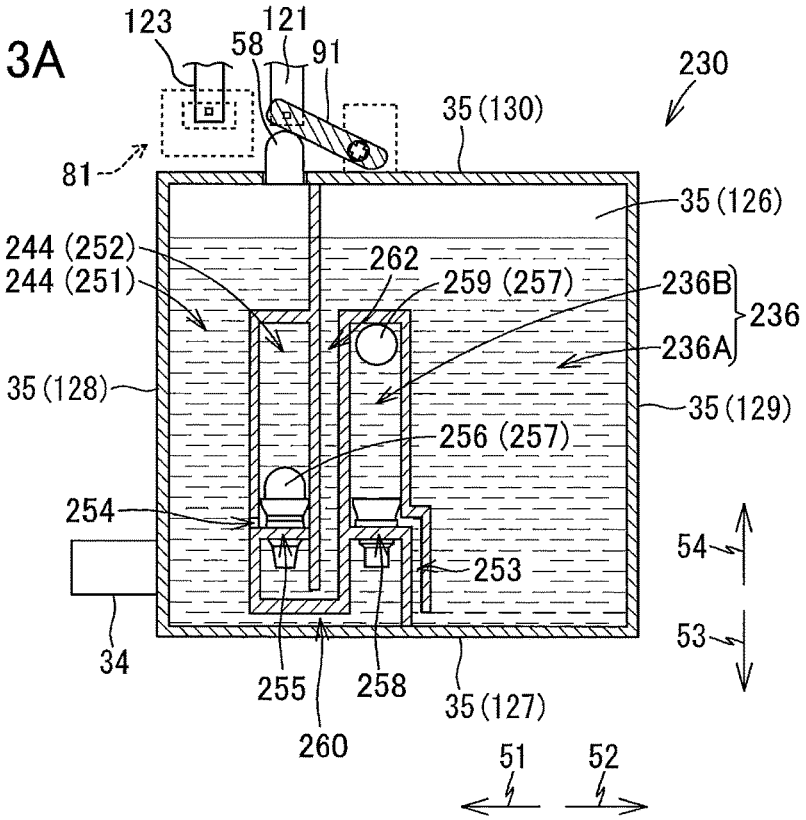

When the ink chamber 236 and the ink channel 244 are filled with ink as illustrated in FIG. 13A, the spherical body 256 sinks to close the opening 255, and the spherical body 259 floats to open the opening 258. Accordingly, when supplying ink from the ink cartridge 230 to the corresponding ink tube 20, ink in the first ink chamber 236A is supplied to the ink tube 20 through the second ink chamber 236B, the first channel 251, and the ink supply portion 34.

Figure 13B:
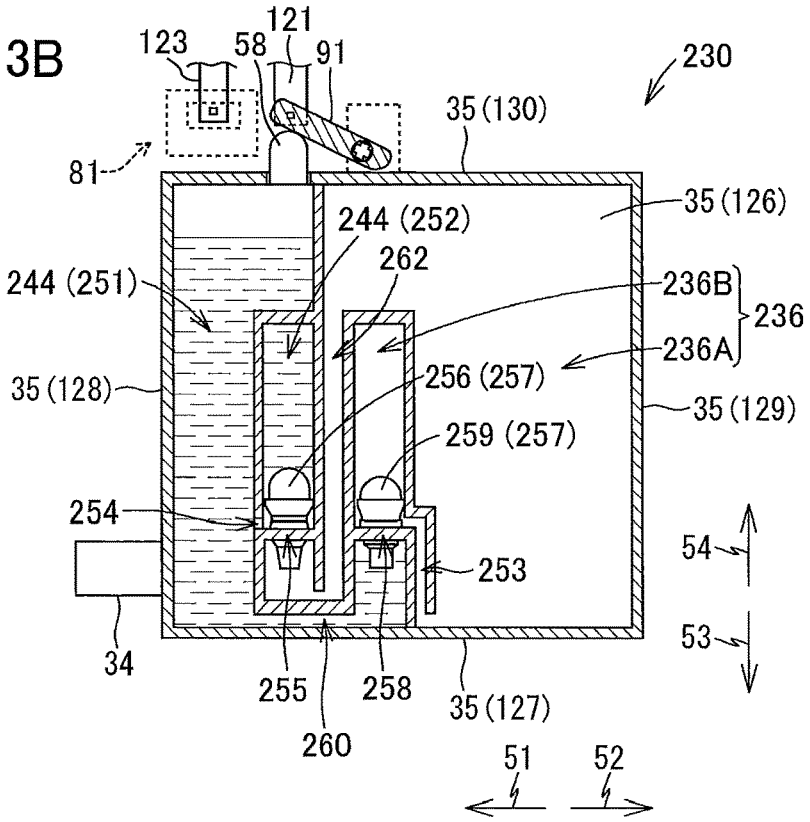

When ink in the ink chamber 236 is reduced to a level illustrated in FIG. 13B, the buoyancy force exerted by ink no longer applies to the spherical body 259. Thus, the spherical body 259 moves in the downward direction 53 to close the opening 258. As a result, communication between the ink channel 244 and the ink chamber 236 is interrupted. Accordingly, ink in the ink channel 244 is supplied to the ink tube 20 through the ink supply portion 34 for supplying ink from the ink cartridge 230 to the ink tube 20.

Figure 13C:
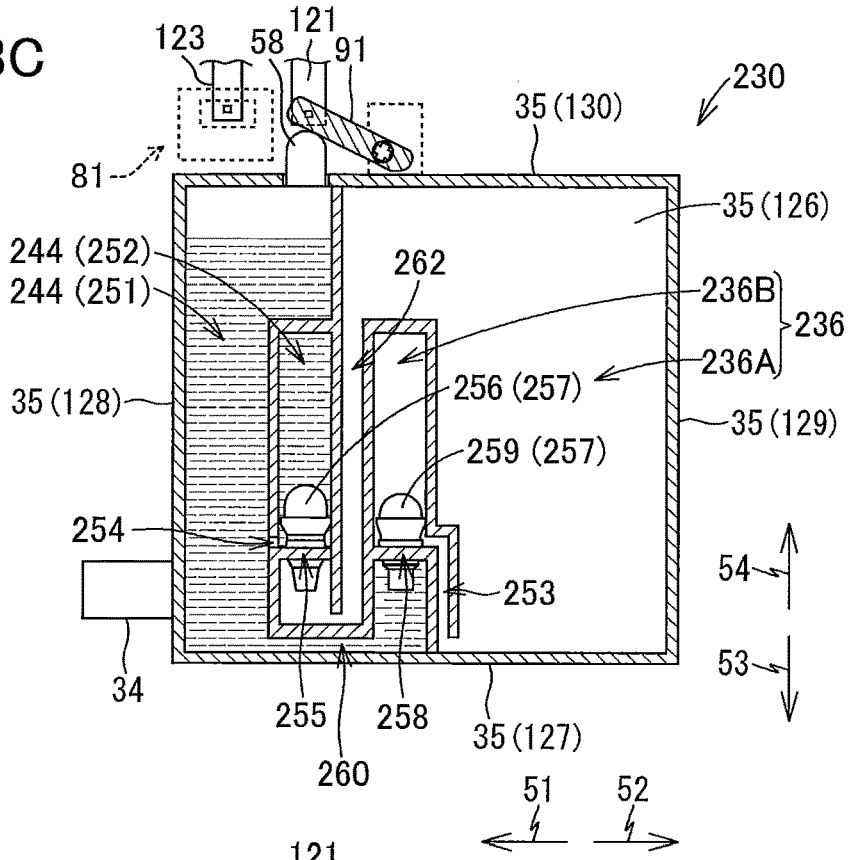

When the amount of ink in the ink channel 244 is reduced, a negative pressure is generated in the ink channel 244 (see FIG. 13C). In FIG. 13C, generation of the negative pressure is illustrated by an increase in density of broken lines in the ink channel 244.

Figure 13D:
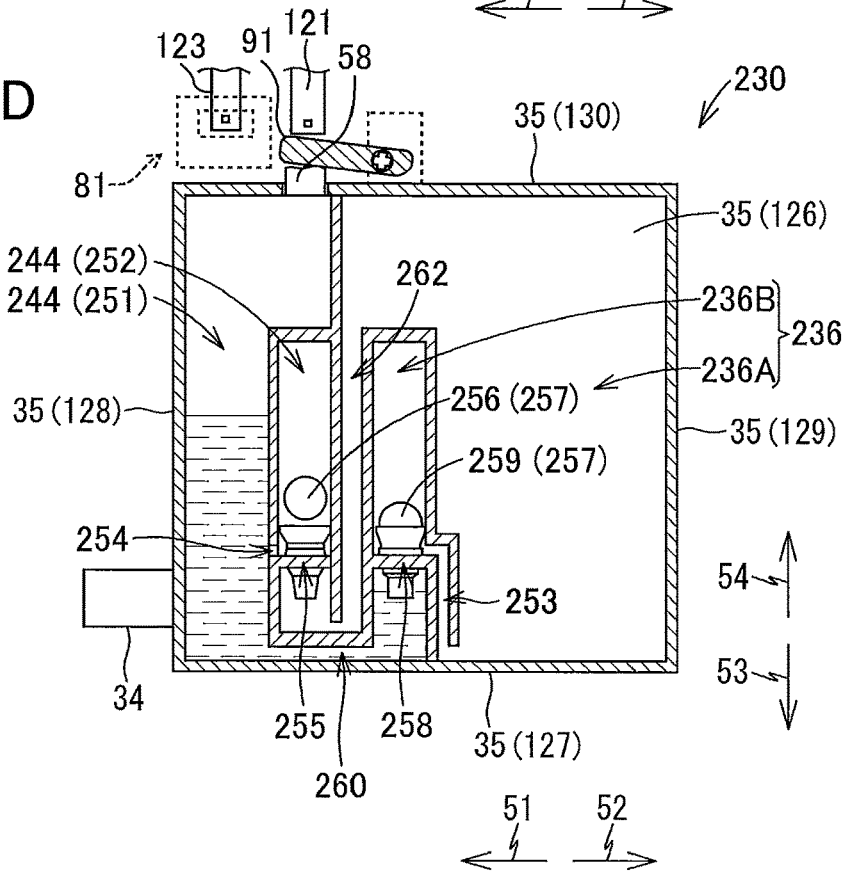

As the negative pressure in the ink channel 244 becomes smaller than the pressure inside the ink chamber 236 by a predetermined value or greater, the spherical body 256 moves in the upward direction 54 due to the negative pressure in the ink channel 244, as illustrated in FIG. 13D. In other words, the spherical body 256 opens the opening 255 when the pressure inside the ink channel 244 is smaller than the pressure inside the ink chamber 236 by the predetermined value or greater. The predetermined value is set to a value that is appropriate to allow ink in the ink channel 244 to reliably and efficiently flow outside thereof by adjusting a material and size of the spherical body 256 or a size of the opening 255.

Further, as the negative pressure in the ink channel 244 becomes smaller than the pressure inside the ink chamber 236 by a predetermined value or greater, the deformable member 58 is elastically deformed so as to deflate in the downward direction 53. As a result, the deformable member 58 is retracted in the downward direction 53 relative to the upper surface of the upper wall 130. The movable member 91 is therefore pivotally moved, due to its own weight or the urging force, such that the detection portion 93 is moved from the first position to the second position. Accordingly, the controller 1 can detect that the amount of ink remaining in the ink chamber 236 and the ink channel 244 becomes small.

When the opening 255 is opened, the first ink chamber 236A and the second channel 252 are brought into communication with each other. As a result, the pressure inside the ink channel 244 returns from the negative pressure to a level slightly closer to an atmospheric pressure. Thus, the spherical body 256 closes the opening 255 again. Note that the pressure inside the ink chamber 236 at this time is set to such a level that the elastically deformed deformable member 58 does not restore its original shape. Thereafter, ink in the ink channel 244 is consumed while repeating opening and closing of the opening 255.

According to the above-described first modification, when a large amount of ink remains in the ink chamber 236, the spherical body 259 is made to float by the buoyancy force, so that the opening 258 is opened. Accordingly, ink stored in the ink chamber 236 flows into the ink channel 244 through the opening 258 and flows out of the ink supply portion 34. Further, since the opening 258 is opened, the pressure inside the ink chamber 236 is equal to the pressure inside the ink channel 244. Thus, the opening 255 is closed.

When the amount of ink remaining in the ink chamber 236 has been reduced, the spherical body 259 can no longer keep afloat, and closes the opening 258. Thus, communication between the ink channel 244 and the ink chamber 236 is interrupted. This allows ink in the ink channel 244 to flow outside of the ink cartridge 230 through the ink supply portion 34. As a result, the negative pressure in the ink channel 244 becomes greater. In other words, the pressure inside the ink channel 244 becomes smaller. The opening 255 is thereby opened, and the pressure inside the ink channel 244 increases to a level the same as the pressure inside the ink chamber 236. When the pressure inside the ink channel 244 becomes the same level as the pressure inside the ink chamber 236, the opening 255 is closed. Thereafter, opening of the opening 255 due to reduction in the pressure inside the ink channel 244 caused by the outflow of ink in the ink channel 244 and closing of the opening 255 due to an increase in the pressure inside the ink channel 244 caused by the opening of the opening 255 are repeated.

In the first modification, the deformable member 58 communicates with the ink chamber 236 through the ink channel 244. Accordingly, the deformable member 58 can be elastically deformed by the change in pressure inside the ink channel 244.

<Other Modifications>

In the above-described embodiment, the movable member 91 is pivotally movable, by its own weight, such that the detection portion 93 is moved from the first position to the second position. However, the movable member 91 may be urged by an urging member such as a torsion coil spring in a direction in which the detection portion 93 moves from the first position to the second position.

Further, the movement of the movable member 91 to cause the detection portion 93 to move from the first position to the second position is not limited to pivotal movement. For example, the movable member 91 may be supported to the rear cover 31 at a position above the upper surface 39 of the rear cover 31 and slidable in the upward direction 54 and the downward direction 53. In this case, the detection portion 93 may be adapted to move from the first position to the second position in accordance with the sliding movement of the movable member 91.

Further, the respective front ends of the right side wall 37, the left side wall 38, the right wall 46 and the left wall 47 may extend to a position further in the forward direction 51 (i.e. forward) relative to the detection portion 93. In this case, the light emitting part and the light receiving part of the optical sensor 123 are positioned between the detection portion 93, and the right side wall 37, the left side wall 38, the right wall 46 and the left wall 47, enabling the controller 1 to detect the detection portion 93 through the optical sensor 123.

In the above-described embodiment, the detection portion 93 of the movable member 91 is disposed such that at least a part of the detection portion 93 overlaps the deformable member 58 in a plan view. However, the detection portion 93 may not overlap the deformable member 58 in a plan view. For example, the detection portion 93 may be positioned further in the forward direction 51 (i.e. forward) relative to the deformable member 58, and a part of the movable member 91 between the detection portion 93 and the support shaft 48 may be adapted to contact the deformable member 58.

In the above-described embodiment, the detection portion 93 is positioned between the light emitting part of the optical sensor 123 and the light receiving part of the optical sensor 123, blocking light emitted from the light emitting part of the optical sensor 123. However, the detection portion 93 may attenuate light emitted from the light emitting part of the optical sensor 123, instead of blocking the light. Specifically, illumination intensity of light received by the light receiving part of the optical sensor 123 when the detection portion 93 is positioned between the light emitting part of the optical sensor 123 and the light receiving part of the optical sensor 123 may only have to be smaller than illumination intensity of light received by the light receiving part of the optical sensor 123 when the detection portion 93 is not positioned between the light emitting part of the optical sensor 123 and the light receiving part of the optical sensor 123.

Further, in the above-described embodiment, the ink chamber 36 is configured of the inner frame 35 and the film 33. However, for example, the ink chamber 36 may not include the inner frame 35. In this case, the ink chamber 36 may be formed as an internal space of a bag-shaped member made of a flexible film. An elastic member, such as a spring, for restricting deformation of the film is provided in the internal space of the bag-shaped member, thereby maintaining a predetermined internal volume against the deformation of the film reducing the internal volume of the ink chamber 36. Hence, pressure inside the internal space is reduced in accordance with consumption of ink.

Further, the ink cartridge 30 may not be provided with the front cover 32 and the rear cover 31. For example, a member corresponding to the inner frame 35 constitutes a casing, and the deformable member 58 and the movable member 91 may be provided on outer surfaces of the inner frame 35.

Ink has been described as an example of liquid in the above-described embodiment. However, liquid is not limited to ink. For example, instead of ink, pretreatment liquid that is ejected to a sheet prior to ink during printing may be used as liquid.

While the description has been made in detail with reference to the embodiment thereof, it would be apparent to those skilled in the art that various changes and modifications may be made therein without departing from the scope of the disclosure.

What is claimed is:

1. A liquid cartridge configured to be inserted into a cartridge attachment section of an inkjet recording apparatus in an insertion direction, the liquid cartridge comprising:

a casing including a liquid chamber configured to store liquid therein, the liquid chamber being configured such that an internal pressure of the liquid chamber is reduced in accordance with outflow of liquid from the liquid chamber, the casing including a front surface and an upper surface defined based on an attached posture of the liquid cartridge to the cartridge attachment section;

a liquid supply portion disposed at the front surface and extending along the insertion direction, the liquid supply portion being configured to allow liquid in the liquid chamber to flow out of the liquid chamber;

a deformable member protruding further upward relative to the upper surface of the casing, the deformable member having an internal space in communication with the liquid chamber, the deformable member being configured to be elastically deformable such that a volume of the internal space is reduced in accordance with the reduction in the internal pressure of the liquid chamber;

a movable member including a detection portion configured to move in an upward direction and a downward direction in accordance with the elastic deformation of the deformable member; and a support member supporting the movable member.

2. The liquid cartridge according to claim 1, wherein the casing includes a wall extending in the upward direction from the upper surface of the casing, and wherein the wall has a front end positioned closer to the support member than the detection portion to the support member.

3. The liquid cartridge according to claim 2, wherein the support member is positioned further upward relative to the upper surface of the casing, and wherein the wall overlaps the support member as viewed in a rightward direction and a leftward direction, the wall having an upper end positioned further upward relative to the support member.

4. The liquid cartridge according to claim 3, wherein the front end of the wall is positioned further rearward relative to the detection portion, the detection portion being exposed to an exterior of the liquid cartridge.

5. The liquid cartridge according to claim 2, wherein the wall has an upper end positioned further upward relative to the detection portion.

6. The liquid cartridge according to claim 2, wherein the movable member is configured to be pivotally movable about the support member.

7. The liquid cartridge according to claim 6, wherein the support member is supported by the wall.

8. The liquid cartridge according to claim 6, wherein the movable member includes a stopper configured to restrict the pivotal movement of the movable member, the stopper being positioned opposite to the detection portion with respect to the support member.

9. The liquid cartridge according to claim 6, wherein the detection portion is configured to move from an upper position where the detection portion is in contact with the deformable member without elastic deformation to a lower position where the detection portion is in contact with the deformable member that has been elastically deformed, and wherein the support member is disposed between the detection portion at the upper position and the detection portion at the lower position in the upward direction and the downward direction.

10. The liquid cartridge according to claim 2, wherein the wall includes a pair of wall portions, one of the pair of wall portions being disposed leftward of the movable member, the other of the pair of wall portions being disposed rightward of the movable member.

11. The liquid cartridge according to claim 1, wherein the deformable member is formed of an elastic material.

12. The liquid cartridge according to claim 1, wherein the detection portion of the movable member is positioned further upward relative to the deformable member.

13. The liquid cartridge according to claim 1, wherein the casing further includes:

a rear surface opposite to the front surface;

a lower surface opposite to the upper surface, the upper surface extending between the front surface and the rear surface; and a film defining a part of the liquid chamber, the film being configured to be deformable in accordance with the outflow of liquid from the liquid chamber such that a volume of the liquid chamber is reduced, and wherein the upper surface of the casing has an opening through which a portion of the deformable member is inserted.

14. The liquid cartridge according to claim 13, wherein the deformable member has a hardness higher than a hardness of the film.

15. The liquid cartridge according to claim 1, wherein the casing has a communication channel for allowing the internal space of the deformable member to communicate with the liquid chamber, the communication channel extending in the upward direction and the downward direction.

16. The liquid cartridge according to claim 1, wherein the insertion direction crosses a direction of a gravitational force acting on the liquid cartridge when the liquid cartridge is in the attached posture, the upward direction and downward direction being parallel to the direction of a gravitational force.

17. The liquid cartridge according to claim 1, wherein the deformable member is positioned upward relative to a level of the liquid stored in the liquid chamber at all times when the liquid cartridge is in the attached posture.

* * * * *